US005758402A

United States Patent [19]

Asano et al.

[11] Patent Number: 5,758,402

[45] Date of Patent: Jun. 2, 1998

[54] WIRE HANDLING APPARATUS

[75] Inventors: Takahiro Asano; Masahiro Ikeji; Nobuo Sato; Tetsuya Yano; Daisuke Morimoto, all of Takarazuka, Japan

[73] Assignee: ShinMaywa Industries, Ltd., Nishinomiya, Japan

[21] Appl. No.: 716,278

[22] PCT Filed: Jan. 30, 1995

[86] PCT No.: PCT/JP95/00120

§ 371 Date: Dec. 12, 1996

§ 102(e) Date: Dec. 12, 1996

[87] PCT Pub. No.: WO96/24179

PCT Pub. Date: Aug. 8, 1996

[51] Int. Cl.[6] ..... H01R 43/00

[52] U.S. Cl. ..... 29/564.4; 29/33 M; 29/753

[58] Field of Search ..... 29/33 M, 33 F, 29/564.4, 564.6, 749, 753, 759, 825

[56] References Cited

U.S. PATENT DOCUMENTS

| | | | |
|---|---|---|---|
| 4,964,200 | 10/1990 | Giesbrecht et al. | 29/33 M |
| 5,025,549 | 6/1991 | Hornung | 29/564.4 |
| 5,038,457 | 8/1991 | Yasushi et al. | 29/564.4 |
| 5,226,224 | 7/1993 | Ishizuka et al. | 29/825 |
| 5,235,735 | 8/1993 | Koch | 29/564.4 |
| 5,282,311 | 2/1994 | Tamura | 29/33 F X |
| 5,285,569 | 2/1994 | Hoffa | 29/33 M X |
| 5,490,316 | 2/1996 | Kimoto | 26/564.4 |

FOREIGN PATENT DOCUMENTS

| | | | |
|---|---|---|---|
| 598276 | 5/1994 | European Pat. Off. | 29/759 |

*Primary Examiner*—William R. Briggs

*Attorney, Agent, or Firm*—Oblon, Spivak, McClelland, Maier & Neustadt, P.C.

[57] ABSTRACT

The wire handling apparatus of the present invention comprises a length measuring unit, a first clamp mechanism and a second clamp mechanism, a cutter mechanism, a first terminal pressing mechanism and a second terminal pressing mechanism, a first carrier mechanism and a second carrier mechanism, and a wire discharge mechanism, and synchronous moving means for upwardly/downwardly moving a receiving clamp part of the wire discharge mechanism in synchronization with upward/downward movement of a clamp part of the said second clamp mechanism in a terminal pressing operation of the said second terminal pressing mechanism is provided while the position of the said receiving clamp part is coincided with the position of a coated wire so that grasping of the coated wire by the receiving clamp part is enabled in the terminal pressing operation of the second terminal pressing mechanism.

7 Claims, 22 Drawing Sheets

WIRE HANDLING APPARATUS

TECHNICAL FIELD

The present invention relates to an improvement of a wire handling apparatus for pressure-connecting terminals to ends of a coated wire.

BACKGROUND OF THE INVENTION

As wire handling apparatuses of this type, wire handling apparatuses disclosed in Japanese Patent Publication No. 5-78883 and Japanese Utility Model Laying-Open Gazette No. 3-95519 are known, for example. These wire handling apparatuses are provided in structures of cutting long coated wires into prescribed lengths, peeling off coated parts on both end portions of the cut coated wire, and pressure-connecting terminals to these wire both end portions of the wire from which the coated parts are peeled off.

Making description as to a general structure of this type of wire handling apparatus, it comprises a length measuring unit 1 having a length measuring roller for intermittently delivering a coated wire W by prescribed dimensions, and a front side clamp 2 (hereinafter referred to as an F clamp) and a rear side clamp 3 (hereinafter referred to as an R clamp) serving as clamp mechanisms for grasping the coated wire W are comprised downstream a wire feed direction in the length measuring unit 1, as shown in FIG. 25.

Further, a cutter mechanism 4 for performing cutting and peeling of the coated wire W is arranged between the F clamp 2 and the R clamp 3. In addition, a front side terminal pressing mechanism 5 is arranged on a side portion of the F clamp 2, a rear side terminal pressing mechanism 6 is arranged on a side portion of the R clamp 3, and carriage mechanisms 7 and 8 for carrying the coated wire W which is grasped by the said F clamp 2 and the R clamp 3 to corresponding positions of the terminal pressing mechanism 5 and the terminal pressing mechanism 6 respectively are arranged. Further, a wire discharge mechanism 9 is arranged on a position approximate to the said rear side terminal pressing mechanism 6.

As a handling operation for the coated wire W, the coated wire W is first fed toward the respective clamps 2 and 3 by the said length measuring unit 1 by prescribed dimensions, and the coated wire W is grasped by these respective clamps 2 and 3. In this state, peeling of a coated part and pressure connection of a terminal 10 are already performed in a precedent wire handling step on a feed direction forward end portion (lower end portion in FIG. 25) of the coated wire W.

In this state, cutting of the coated wire W and peeling of coated parts of these cut end portions are performed by the cutter mechanism 4 in an intermediate position between the F clamp 2 and the R clamp 3. Thereafter an operation of pressure-connecting terminals 10 to end portions of this coated wire W is performed. In this pressing operation, the F clamp 2 first moves to the front side terminal pressing mechanism 5 position while grasping the coated wire W, and the R clamp 3 moves to the rear side terminal pressing mechanism 6 position while grasping the coated wire W simultaneously with this (refer to phantom lines).

The operation for pressure-connecting the terminals 10 to the end portions of the coated wire W is performed in the front side terminal pressing mechanism 5 and the rear side terminal pressing mechanism 6 in this state, and thereafter the F clamp 2 returns to the initial position (position shown by the solid lines) while grasping the coated wire W, and the R clamp 3 transfers the coated wire W to the wire discharge mechanism 9 and thereafter returns to the initial position (position shown by sold lines) without grasping the coated wire W. Such an operation is so repeated that coated wires W pressure-connected with the terminals 10 on both end portions are successively manufactured in prescribed lengths.

In the aforementioned wire handling apparatus, however, the F clamp 2 side can make the return operation to the initial position start immediately after the pressing operation while the return operation of the R clamp 3 side to the initial position cannot be started until the pressing operation is performed and the coated wire W is thereafter transferred to the wire discharge mechanism 9, when the F clamp 2 and the R clamp 3 return to the initial positions after the operation for pressure-connecting the terminals 10 to the end portions of the coated wire W is performed. Therefore, the F clamp 2 returns to the initial position earlier than the R clamp 3, and the F clamp 2 must wait until the R clamp 3 returns to the initial position, and enters such a state that the same cannot move to the next step unless the R clamp 3 returns to the initial position. Thus, the transfer operation of the coated wire W to the wire discharge mechanism 9 is performed after the pressing operation of the terminal 10 on the R clamp 3 side, and hence there has been a limit in attainment of reduction of the wire handling time.

In consideration of this point, it comes to that the R clamp 3 can be rendered to make the return operation to the initial position immediately after the pressing operation and reduction of the wire handling time can be attained when the operation for pressure-connecting the terminal 10 to the end portion of the coated wire W in the rear side terminal pressing mechanism 6 and the transfer operation of the coated wire W from the R clamp 3 to the wire discharge mechanism 9 are simultaneously performed. As one type of the aforementioned wire handling apparatus, there is an apparatus of such a structure that the R clamp 3 upwardly/downwardly moves at the time of the operation for pressure-connecting the terminal to the end portion of the coated wire W.

Namely, when the R clamp 3 moves to a position opposed to the rear side terminal pressing mechanism 6 in case of such a structure that the coated wire W grasped by the R clamp 3 moves toward a pressure connection bed 6a of the rear side terminal pressing mechanism 6 (moves in the vertical direction in FIG. 26) as shown in FIG. 26, the height of the coated wire W grasped by the R clamp 3 is positioned upward beyond the arrangement height of the terminal 10, in order to avoid interference between the coated wire W grasped by this R clamp 3 and the terminal 10.

In this case, the R clamp 3 is lowered to move the coated wire W to the arrangement position of the terminal 10 for thereafter performing pressure connection of the terminal 10 and thereafter raising up the R clamp 3 and returning the same to the original position, in order to prevent bending of the coated wire W in pressure connection of the terminal 10.

When the operation for pressure-connecting the terminal 10 to an end portion of the coated wire W in the rear side terminal pressing mechanism 6 and the transfer operation of the coated wire W from the R clamp 3 to the wire discharge mechanism 9 are made to be simultaneously performed as described above in the wire handling apparatus performing such operations, means of making the wire discharge mechanism 9 positioned in correspondence to the lower position of the R clamp 3 so that the coated wire W is transferred to the wire discharge machine 7 at the same time when the R clamp 3 reaches the lower position and a prescribed pressing operation is performed.

In case of employing such a structure, however, the coated wire W and the wire discharge mechanism 9 relatively vertically move, and hence it is necessary to temporarily stop the coated wire W on the lower position by a prescribed time, in order to enable the wire discharge mechanism 9 to reliably grasp the coated wire W.

Namely, if the coated wire W is not stopped in the lower position or this stop time is short, there is such an apprehension that the wire discharge mechanism 9 cannot grasp a prescribed position of the coated wire W, and in such case, there is also such an apprehension that the coated wire W cannot be discharged from the apparatus, or the coated wire W is bent to cause occurrence of product imperfection. In such case of temporarily stopping the coated wire W on the lower position by a prescribed time, further, extension of the working time is brought as such.

According to the apparatus disclosed in Japanese Utility Model Laying-Open Gazette No. 3-95519, the apparatus is brought into such a structure that elastic pressure by a pair of length measuring rollers 11 of a measuring unit 1 is temporarily canceled when a terminal 10 is pressure-connected to an end portion of a coated wire W which is grasped by an F clamp 2 in a front side terminal pressing mechanism 5, and thereafter the F clamp 2 is downwardly swung in synchronization about a base end side of the F clamp 2 which is swingably supported on the measuring unit 1 side and pressure connection of the terminal 10 is performed in this state.

According to this apparatus, the wire W is not regularly elastically pressed by the pair of length measuring rollers 11 in pressure connection of the terminal 10 and hence occurrence of elongation or a bending tendency of the coated wire W can be prevented in swinging of the F clamp 2, while it is necessary to separately provide contact/separation driving means for contact/separation-operating the pair of length measuring rollers 11, and control thereof is also required, to disadvantageously result in complication of the structure.

When the length measuring rollers 11 are temporarily separated to perform pressure connection of the terminal 10 and thereafter the length measuring rollers 11 are again made to elastically press the wire, further, deflection of the coated wire W is caused between the F clamp 2 and the length measuring rollers 9, to result in such a problem that dispersion takes place in the measured length in a next length measuring step.

DISCLOSURE OF THE INVENTION

In consideration of the aforementioned problems, the present invention is aimed at providing a wire handling apparatus which attains reduction of a wire handling time, prevents elongation and a bending tendency of a wire and also effectively prevents occurrence of dispersion of a measured length.

The object of the present invention is attained, in a wire handling apparatus comprising a length measuring unit for intermittently delivering a coated wire by prescribed dimensions, a first clamp mechanism and a second clamp mechanism which are successively arranged downstream a wire feed direction of the length measuring unit for releasably grasping the said delivered coated wire, a cutter mechanism which is positioned and arranged between the said both clamp mechanisms for performing cutting-peeling of the coated wire grasped by the said respective clamp mechanisms, a first terminal pressing mechanism and a second terminal pressing mechanism which are arranged in correspondence to side portions of the said respective clamp mechanisms respectively for pressure-connecting terminals to end portions of the said peeled coated wire, a first carrier mechanism and a second carrier mechanism for carrying the coated wire respectively grasped by clamp parts of the said first clamp mechanism and the second clamp mechanism to the corresponding portions of the first terminal pressing mechanism and the second terminal pressing mechanism position respectively, and a wire discharge mechanism having a receiving clamp part receiving the coated wire to which the terminal is pressure-connected by the second terminal pressing mechanism from the clamp part of the second clamp mechanism so that the clamp part of the second clamp mechanism is upwardly/downwardly moved in a terminal pressing operation by the second terminal pressing mechanism, by providing a wire handling apparatus provided with synchronous moving means for upwardly/downwardly moving the said receiving clamp part in synchronization with the upward/downward movement of the clamp part of the said second clamp mechanism in the terminal pressing operation of the said second terminal pressing mechanism in which the position of the said receiving clamp part is coincided with the position of the coated wire so that grasp of the coated wire by the receiving clamp part is enabled in the terminal pressing operation of the second terminal pressing mechanism.

The said synchronous moving means may be formed to comprise a first moving member which is integrally provided on the receiving clamp part of the wire discharge mechanism, and a second moving member which is integrally provided on the clamp part of the second clamp mechanism and arranged in proximity to the said first moving member, so that the second moving member comes into contact with the first moving member following the upward/downward movement of the said second clamp mechanism in the terminal pressing operation of the said second terminal pressing machine for moving the said receiving clamp part in synchronization with the upward/downward movement of the clamp part of the said second clamp mechanism.

Further, the said second moving member may be in a structure of being set on a position having a slight space with respect to the said first moving member.

The apparatus may be so formed that the said length measuring unit comprises a pair of length measuring rollers which are separably elastically pressed against each other for delivering the said coated wire, the said first carrier mechanism comprises a horizontal moving part which is moved in a horizontal plane, the said length measuring rollers and the first clamp mechanism are mounted on a swing member which is vertically swingably supported on the horizontal moving part side, and synchronous swing means for engaging with the said swing member and vertically swinging the swing member is provided in order to upwardly/downwardly move the first clamp mechanism in the terminal pressing operation by the said first terminal pressing mechanism.

Further, the apparatus may be in a structure comprising a return member for upwardly returning the said swing member to an initial position.

On the other hand, the present invention may be in such a structure that, in a wire handling apparatus comprising a length measuring unit comprising a pair of length measuring rollers for intermittently delivering a coated wire by prescribed dimensions, a clamp mechanism which is arranged downstream a wire feed direction of the length measuring unit for releasably grasping the said delivered coated wire, a cutter mechanism performing cutting-peeling of the coated wire grasped by the clamp mechanism, a terminal pressing mechanism which is arranged in correspondence to a side portion of the said clamp mechanism for pressure-connecting a terminal to an end portion of the coated wire subjected to the said peeling, and a carrier mechanism for carrying the coated wire grasped by the said clamp mechanism to the terminal pressing mechanism position so that the said clamp mechanism is upwardly/downwardly moved in a terminal pressing operation by the said terminal pressing mechanism, the said carrier mechanism comprises a horizontal moving part which is moved in a horizontal plane, the said pair of length measuring rollers and the clamp mechanism are mounted on a swing member which is vertically swingably supported on the horizontal moving part side, and synchronous swing means for engaging with the said swing member and vertically swinging the swing member is provided for upwardly/downwardly moving the clamp mechanism in the terminal pressing operation by the said terminal pressing mechanism.

Further, the apparatus may be in a structure comprising a return member for upwardly returning the said swing member to an initial position.

BEST MODES FOR CARRYING OUT THE INVENTION

A first embodiment of the present invention is now described on the basis of the drawings.

Figure 1:
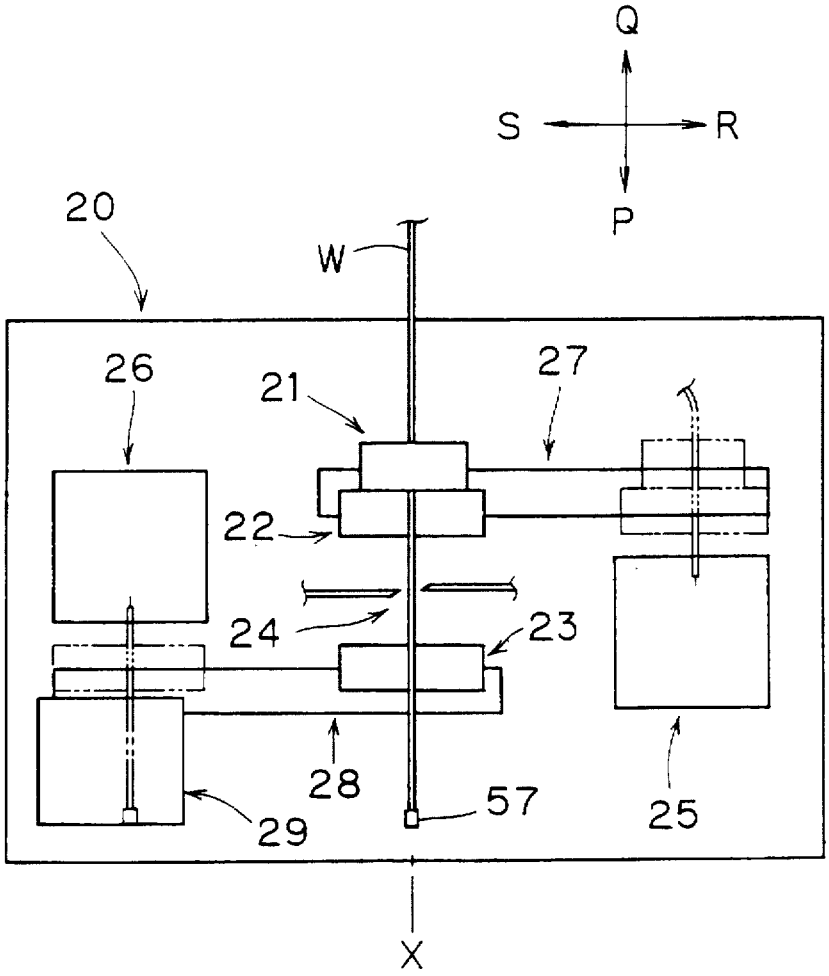
FIG. 1 is a schematic explanatory diagram in a first embodiment of the present invention.

FIG. 1 is an explanatory diagram showing the overall system of a wire handling apparatus 20, and this wire handling apparatus 20 comprises a length measuring unit 21 for intermittently delivering a coated wire W by prescribed dimensions, and a front side clamp 22 (hereinafter referred to as an F clamp) serving as a first clamp mechanism and a rear side clamp 23 (hereinafter referred to as an R clamp) serving as a second clamp mechanism which are arranged downstream a wire feed direction in the length measuring unit 21 for releasably grasping the coated wire W delivered from the length measuring unit 21, similarly to the prior art.

Further, a cutter mechanism 24 for performing cutting-peeling of the coated wire W is arranged between the F clamp 22 and the R clamp 23. In addition, a front side terminal pressing machine 25 serving as a first terminal pressing mechanism is arranged on one side portion of the F clamp 22, while a rear side terminal pressing machine 26 serving as a second terminal pressing mechanism is arranged on the other side portion of the R clamp 23. Further, a first carrier mechanism 27 and a second carrier mechanism 28 for carrying the coated wire W grasped by the F clamp 22 and the R clamp 23 to the corresponding positions of the terminal pressing machines 25 and 26 respectively are arranged. In addition, a wire discharge machine 29 serving as a wire discharge mechanism is arranged on a position approximate to this rear side terminal pressing machine 26.

Figure 2:
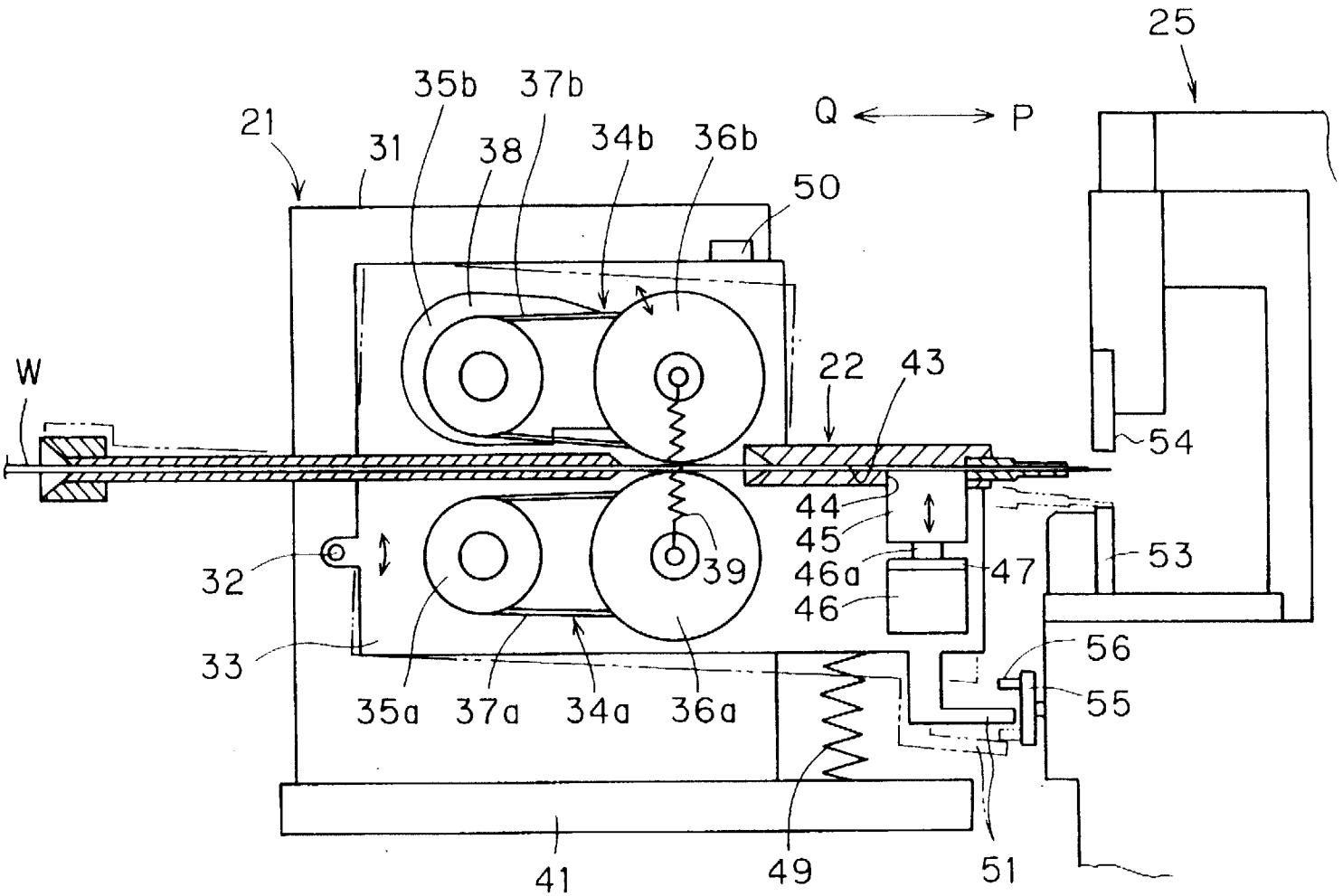
FIG. 2 is a side elevational view of a length measuring unit and an F clamp part.

The said length measuring unit 21 has a length measuring unit body 31, a swing holder 33 serving as a swing member which is mounted on the length measuring unit body 31 through a spindle 32 to be rotatable about a transverse axis going straight with a wire feed line X (refer to FIG. 1) on one end side, and a pair of feed parts **34*a* and 34*b* which are arranged on upper and lower portions through the wire feed line X, as shown in FIG. 2**.

On the lower side feed part **34*a*, a pulley 35*a* and a length measuring roller 36*a* are rotatably mounted on the swing holder 33 respectively in correspondence to a portion under the wire feed line X, while a belt 37*a* is extended between the said pulley 35*a* and a non-illustrated pulley which is fixed to the length measuring roller 36*a***.

On the other hand, a swing arm 38 is comprised in the upper side feed part **34*b*, and a pulley 35*b* and a length measuring roller 36*b* are rotatably mounted on both end portions of the swing arm 37 respectively while a belt 37*b* is extended between the said pulley 35*b* and a non-illustrated pulley which is fixed to the length measuring roller 36*b***.

The rotary shaft of the pulley **35*b* is rotatably mounted on the swing holder 33, and the apparatus is so formed that the swing arm 38 swings about the rotary shaft, whereby the upper side length measuring roller 36*b*** upwardly/ downwardly moves to come into contact/separate from the lower side length measuring roller 36a from above the wire feed line X. Further, a tension spring 39 is extended between both rotary shafts of both length measuring rollers 36a and 36b, so that both length measuring rollers 36a and 36b are in states being elastically pressed against each other by urging force of the tension spring 39.

The said pair of pulleys 35a and 35b are formed to rotate in opposite directions to each other by non-illustrated rotation driving means which is mounted on the swing holder 33, and the length measuring rollers 36a and 36b are formed to be rotated in opposite directions to each other by rotation driving of the pulleys 35a and 35b through the belts 37a and 37b.

The length measuring unit body 31 is mounted on a horizontal moving plate 41 serving as a horizontal moving part, and the horizontal moving plate 41 is formed to be moved in a horizontal plane in two-dimensional directions by a first carrier mechanism 27. Namely, the same is formed to be freely movable in the front-rear directions shown by arrows P and Q in FIG. 1 and right-left directions shown by arrows R and S.

A wire insertion hole 43 capable of receiving the coated wire W is formed in the said F clamp 22, and a concave part 44 communicating with the wire insertion hole 43 is formed in a lower portion of the F clamp 22. In the concave part 44, a clamp pawl 45 is stored to be reciprocable in the vertical direction perpendicular to the wire feed line X. Further, a cylinder 46 is arranged in correspondence to the clamp pawl 45, and mounted on the swing holder 33 side through a cylinder mounting member 47. The said clamp pawl 45 is mounted on the forward end of a piston rod 46a of the cylinder 46.

The apparatus is so formed that the clamp pawl 45 reciprocally drives by driving of the cylinder 46, the coated wire W inserted in the wire insertion hole 43 is grasped-released by the clamp pawl 45 and the inner peripheral surface of the wire insertion hole 43, and a clamp part grasping the coated wire W is formed by these.

Further, a return member 49 consisting of a coil spring or the like for pressing up and urging the swing holder 33 is arranged between a lower end portion of the swing holder 33 on the F clamp 22 side and the upper surface of the horizontal moving plate 41, and the apparatus is so formed that the swing holder 33 separably comes into contact with a stopper 50 which is mounted on the length measuring unit body 31, whereby the longitudinal direction of the wire insertion hole 43 is along the wire feed line X.

In addition, an engaging plate 51 for clamp lowering which is brought into a state extended toward the wire feed direction (direction of arrow P) is mounted on a lower end of an end portion of the swing holder 33 on the F clamp 22 side.

On the said terminal pressing machine 25, a pressure connection bed 53 is provided in correspondence to a downstream side end portion of the coated wire W which is grasped by the F clamp 22 while a pressure connection die 54 is provided on a position above the pressure connection bed 53 as shown in FIG. 2, and the apparatus is so formed that the pressure connection die 54 upwardly/downwardly drives by driving of non-illustrated driving means.

Further, a turntable 55 is mounted on a lower portion of the terminal pressing machine 25 to be freely rotatable in a plane going straight with respect to the wire feed line X, while an eccentric shaft 56 which is arranged eccentrically toward one side from the rotation axis thereof and disengageably engageable with the engaging plate 51 of the said swing holder 33 is projectingly provided on one surface side of this turntable 55.

The turntable 55 is interlocked/coupled with the pressure connection die 54 through a power transmission mechanism such as a non-illustrated crank mechanism or the like, and the turntable 55 is formed to rotate in synchronization with up/down driving of the pressure connection die 54. In this case, the apparatus is so set that the eccentric shaft 56 is positioned on an upper position (solid line position) on an upward position of the pressure connection die 54, and on a lower position (phantom line position) on a downward position of the pressure connection die 54 respectively.

The operation is now described. When lowering of the said pressure connection die 54 is started, the turntable 55 rotates in synchronization with the lowering, and the eccentric shaft 56 downwardly rotates. Thus, the eccentric shaft 56 engages with the engaging plate 51 of the swing holder 33 for downwardly swinging the swing holder 33 against the urging force of the return member 49, and positioning an end portion of the coated wire W which is grasped by the F clamp 22 on a terminal (not shown) which is brought into a placed state on the pressure connection bed 53. At this time, the lowering of the pressure connection die 54 is completed and the peeled end portion of the coated wire W is held by the pressure connection die 54 and the pressure connection bed 53, so that a terminal 57 (refer to FIG. 3) is pressure-connected to the end portion of the coated wire W.

Thereafter the eccentric shaft 56 upwardly rotates by upward movement of the pressure connection die 54. Thus, the pushdown force of the eccentric shaft 56 for the engaging plate 51 is released, and the swing holder 33 is upwardly urged by the urging force of the return member 49 and upwardly returned to the initial position to be in contact with the stopper 50.

As hereinabove described, the apparatus is so formed that the swing holder 33 is vertically swung about the spindle 32 through the eccentric shaft 56 and the engaging plate 51, and synchronous swing means for vertically swinging the swing holder 33 is formed by these engaging plate 51, turntable 55, eccentric shaft 56 and the like.

Figure 3:
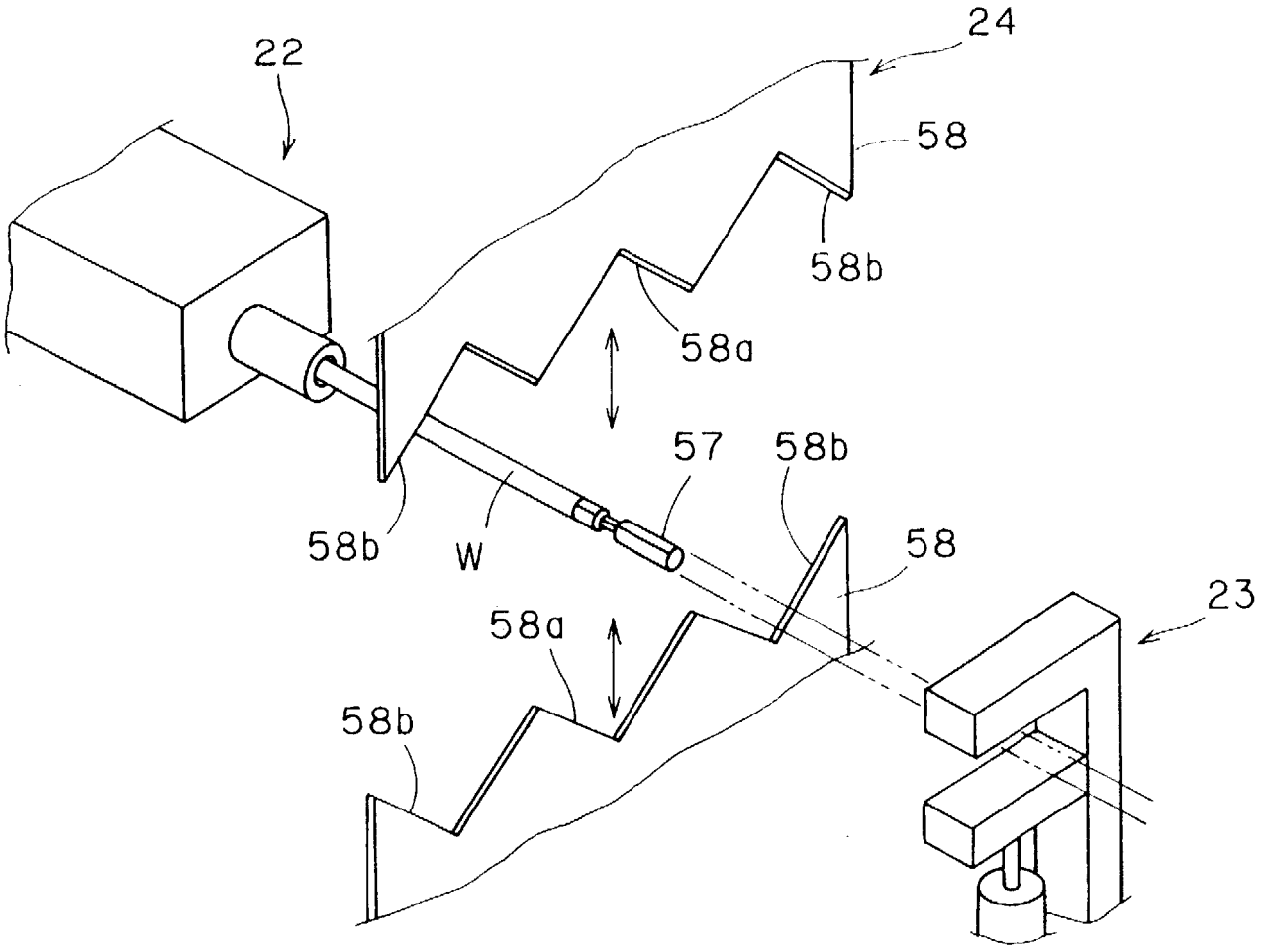
FIG. 3 is a perspective view of a cutter mechanism part.

The said cutter mechanism 24 comprises a pair of cutters 58 as shown in FIG. 3, and the pair of cutters 58 are supported by a non-illustrated cutter body in upper and lower positions through the wire feed line X to be movable along the vertical direction respectively. The apparatus is so formed that both cutters 58 switch-operate by driving of non-illustrated cutter driving means.

Further, the respective cutters 58 are formed on cross-directional central positions which are opposite to each other with cutting blade parts 58a for cutting the coated wire W respectively, and peeling blade parts 58b for peeling the coated part of the coated wire W are formed on both side positions respectively.

Figure 4:
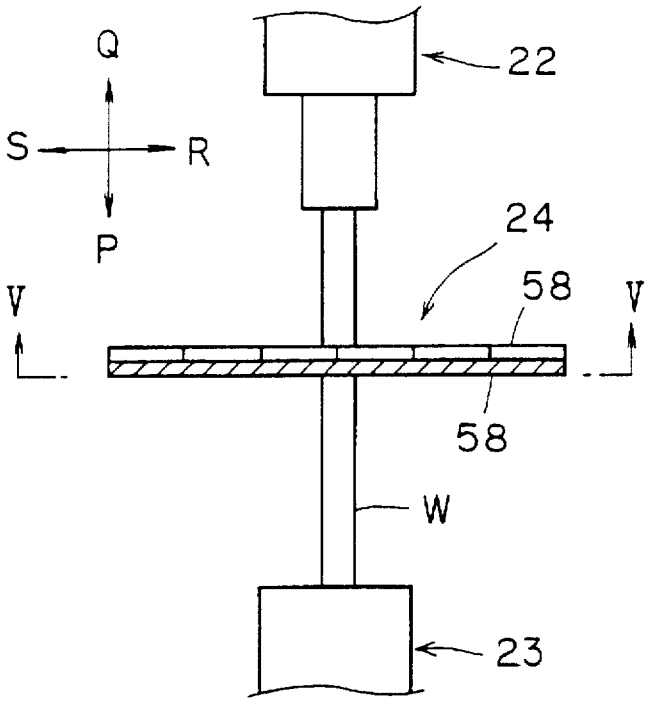
FIG. 4 is a plan view of the cutter mechanism part.
Figure 5:
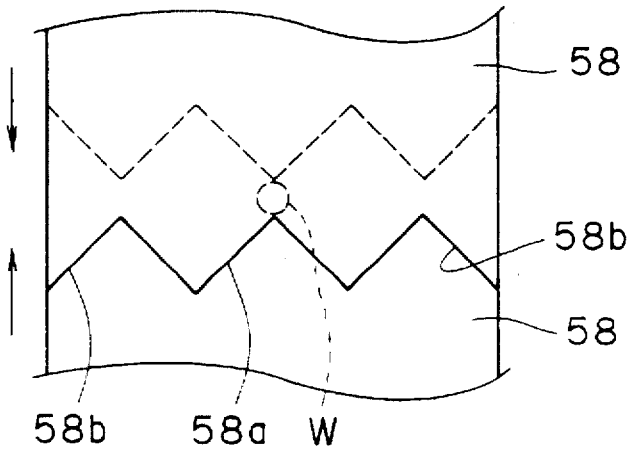
FIG. 5 is a diagram as viewed along the line V—V in FIG. 4.

The coated wire W delivered from the length measuring unit 21 is grasped by both clamps 22 and 23 positioned on the initial positions, and the respective cutters 58 of the cutter mechanism 24 are close-operated in this state so that the coated wire W is cut in full closed states of the respective cutters 58, as shown in FIG. 4 and FIG. 5.

Figure 6:
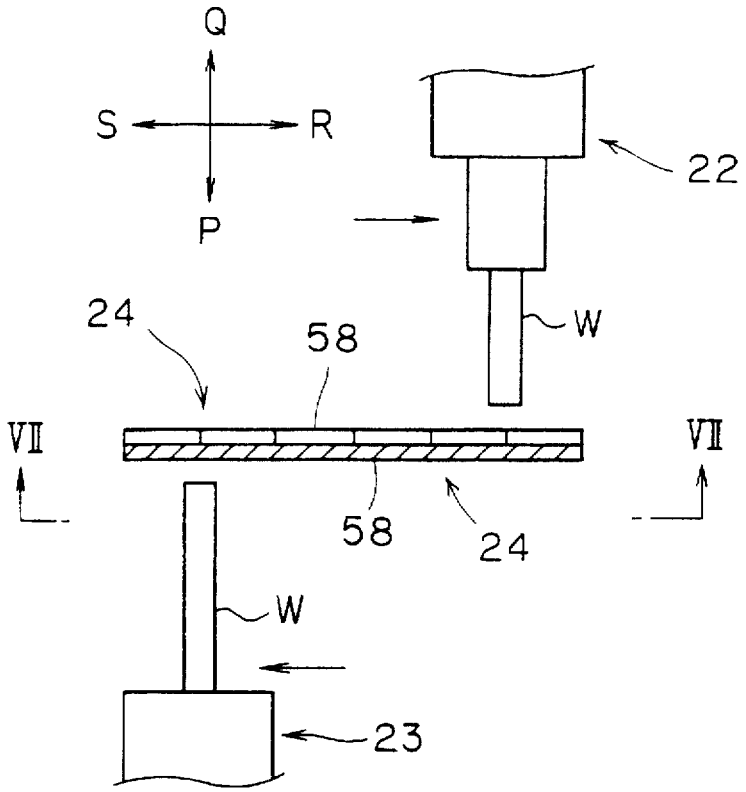
FIG. 6 is a plan view of the cutter mechanism part.
Figure 7:
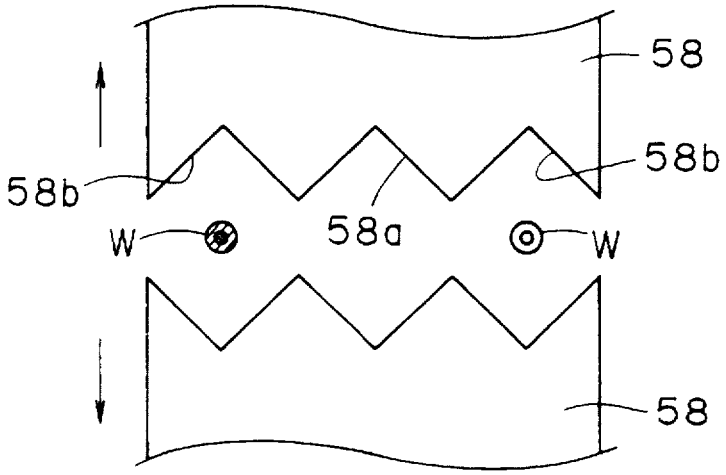
FIG. 7 is a diagram as viewed along the line VII—VII in FIG. 6.

Thereafter the respective cutters 58 are open-operated and enter full open states, and the F clamp 22 and the R clamp 23 are transversely operated (directions of arrows R and S) in opposite directions to each other in this state, to be stopped on positions corresponding to the peeling blade parts 58b of the respective cutters 58 respectively as shown in FIG. 6 and FIG. 7 (peeling positions).

Figure 8:
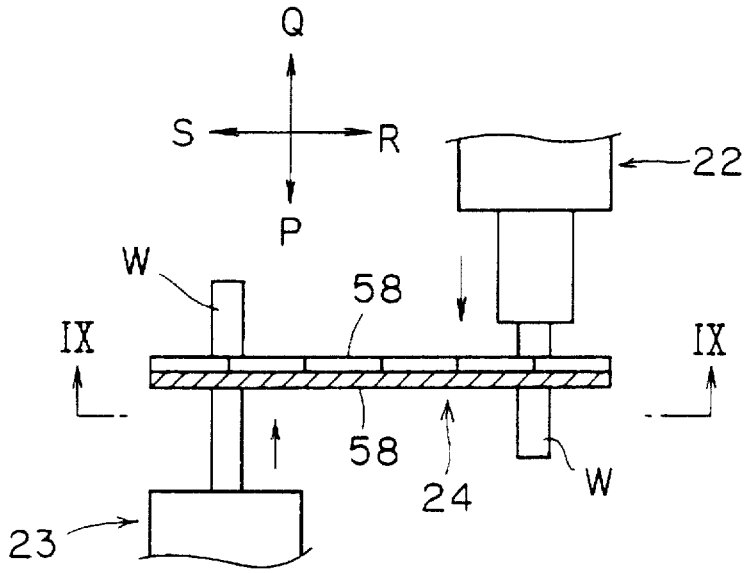
FIG. 8 is a plan view of the cutter mechanism part.
Figure 9:
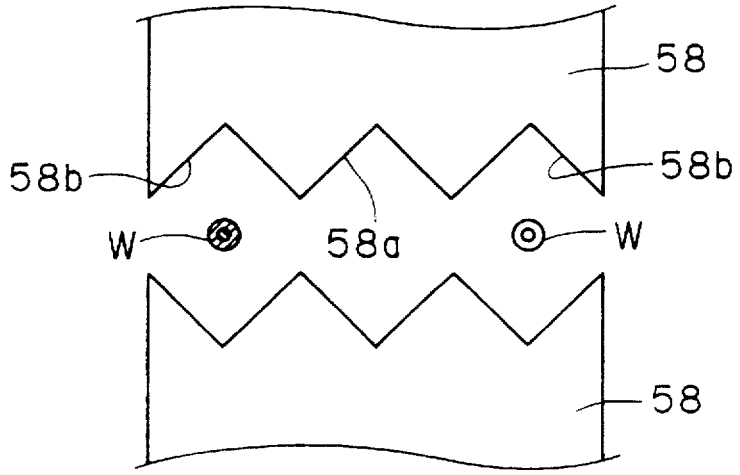
FIG. 9 is a diagram as viewed along the line IX—IX in FIG. 8.

Then, the F clamp 22 and the R clamp 23 are mutually moved/operated in front-rear directions (directions of arrows P and Q) by distances corresponding to peeling lengths for end portions of the coated wires W as shown in FIGS. 8 and 9 (cutting positions).

Figure 10:
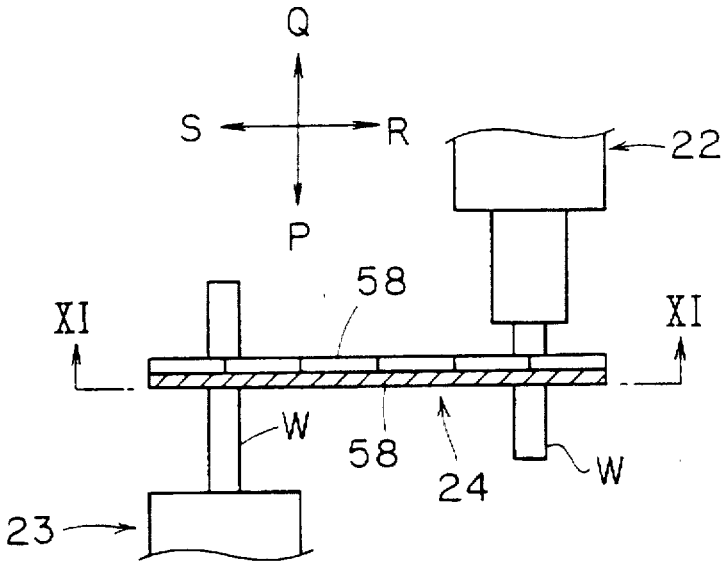
FIG. 10 is a plan view of the cutter mechanism part.
Figure 11:
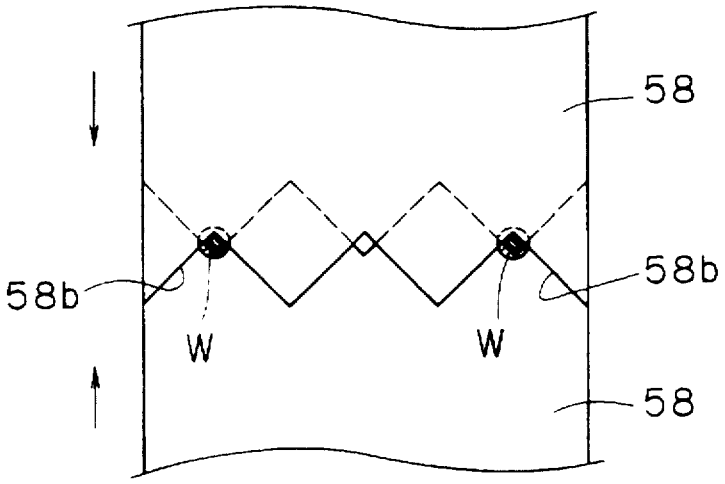
FIG. 11 is a diagram as viewed along the line X—XI in FIG. 10.

Thereafter the respective cutters 58 are close-operated so that the respective cutters 58 are brought into slightly opened states and the peeling blade parts 58*b* of the respective cutters 58 are brought into states biting into coated parts Wa of the coated wires W, as shown in FIG. 10 and FIG. 11.

Figure 12:
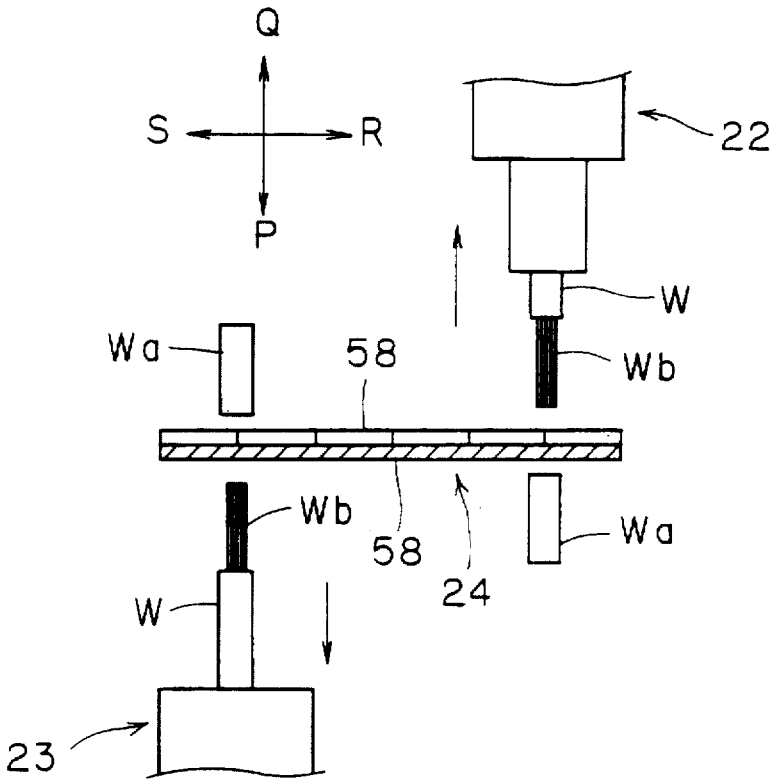
FIG. 12 is a plan view of the cutter mechanism part.

In this state, the F clamp 22 and the R clamp 22 are mutually moved/operated in the front-rear directions (the directions of arrows P and Q) which are opposite directions to the above as shown in FIG. 12, so that the coated parts Wa of the end portions of the coated wires W are peeled and core parts Wb of prescribed lengths are brought into exposed stated (peeling positions). Here, the end portions of the respective coated wires W cut by the cutter mechanism 24 are continuously and simultaneously peeled.

The said R clamp 23 is also formed to be reciprocated by the second carrier mechanism 28 between the initial position shown by solid lines in FIG. 1 and a terminal pressing position opposite to the rear side terminal pressing machine 26 shown by phantom lines, similarly to the F clamp 22. Namely, the same is formed to be movable/operable in the front-rear directions shown by arrows P and Q in FIG. 1 and the right-left directions shown by arrows R and S.

Figure 13:
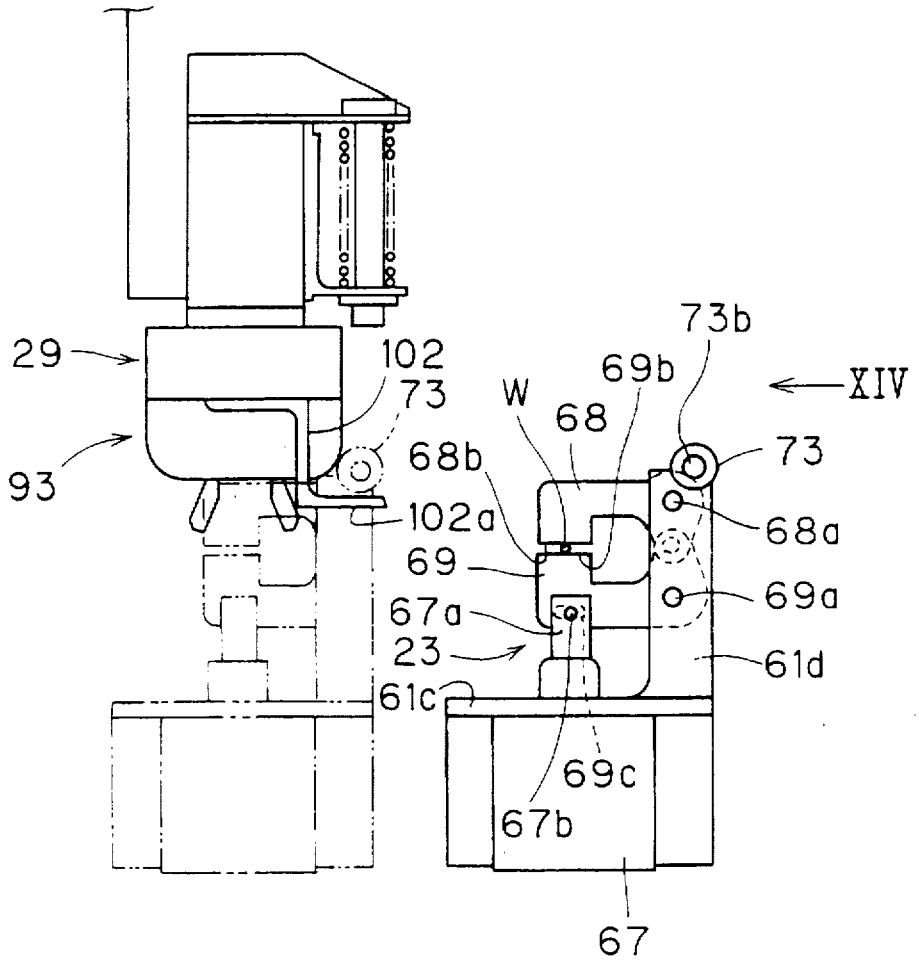
FIG. 13 is an explanatory diagram showing an R clamp and a wire discharge machine before, starting of terminal pressure connection.
Figure 14:
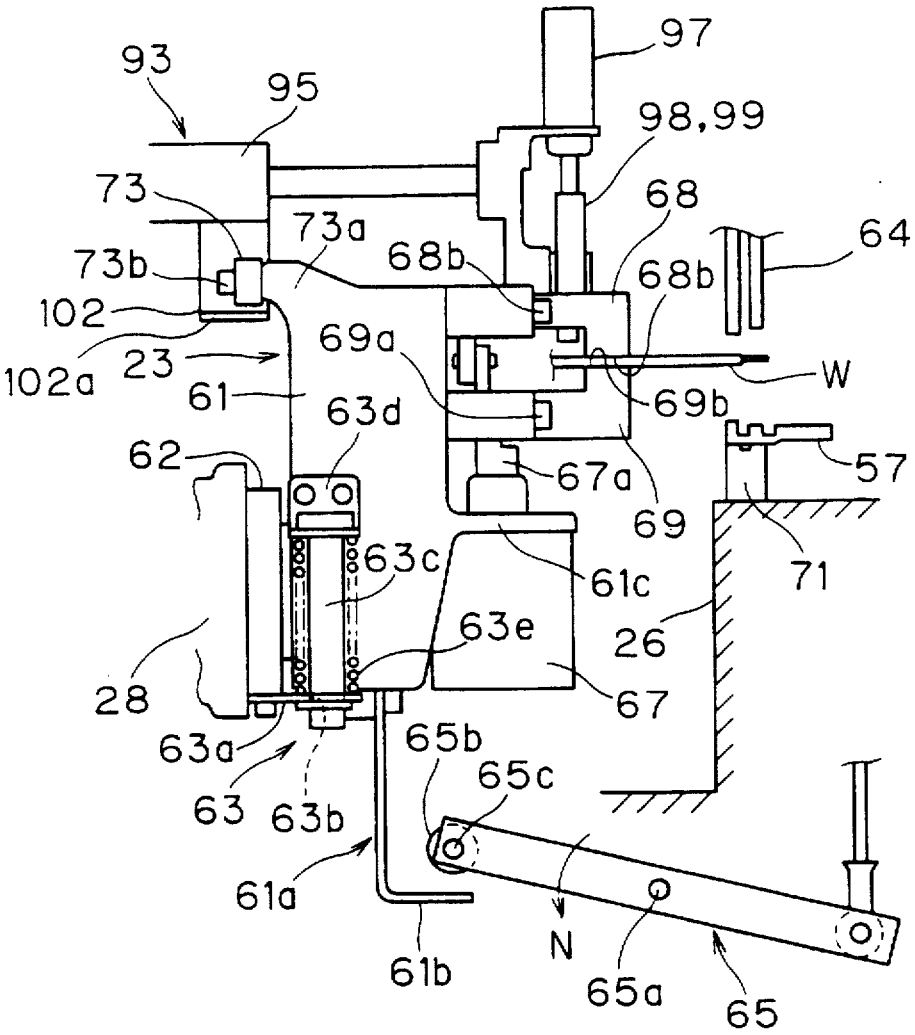
FIG. 14 is a diagram as viewed along arrow XIV in FIG. 13.

As shown in FIG. 13 and FIG. 14, a clamp body 61 of the R clamp 23 is supported by a guide rail 62 comprised in the second carrier mechanism 28 through an up/down mechanism 63, and formed to be horizontally moved (the directions of arrows R and S in FIG. 1) integrally with the up/down mechanism 63 between the said initial position and the terminal pressing position along the said guide rail 62 following driving of a non-illustrated driving source.

An L-shaped arm member 61a is extendedly provided on a lower end portion of the clamp body 61, and the apparatus is so formed that an end of a linkage rod 65 interlocking with a pressure connection die 64 described later is separably brought into contact with a horizontal part 61*b* of this arm member 61*a*. In the said linkage rod 65, its longitudinal intermediate position is supported by a spindle 65*a* extending in the horizontal direction, and the linkage rod 65 is formed to be rotatable about this spindle 65*a*.

An end (right side end in FIG. 14) of this linkage rod 65 is mechanically interlocked with respect to the pressure connection die 64 lowering in the terminal pressing operation, and the linkage rod 65 is formed to be rotated in a direction shown by arrow N in FIG. 14 following lowering of this pressure connection die 64.

Further, a roller 65*b* is rollably supported on the other end (left side end in FIG. 14) of this linkage rod 65 by a spindle 65*c* extending in the horizontal direction, and the outer peripheral surface of this roller 65*b* is formed to separably come into contact with an upper surface of the horizontal part 61*b* of the said arm member 61*a*. Thus, downward urging force is supplied from the said roller 65*b* to the arm member 61*a* in the terminal pressing operation by the lowering of the pressure connection die 64 due to rotation (direction of arrow N) of the linkage rod 65, and it comes to that urging force pushing down the clamp body 61 is supplied.

The said up/down mechanism 63 comprises a support bracket 63*a* which is mounted on a lower end portion of the said guide rail 62 to be movable along the guide rail 62 and an up/down rod 63*c* inserted in a vertically passing opening 63*b* which is formed in the support bracket 63*a*. Further, an upper end portion of this up/down rod 63*c* is connected to the clamp body 61 through an L-shaped bracket 63*d*, while a coil spring 63*e* is compressedly mounted between this L-shaped bracket 63*d* and the said support bracket 63*a*.

The apparatus is so formed that, when downward urging force acts on the said clamp body 61 following the said terminal pressing operation, the up/down rod 63*c* also lowers following lowering of the clamp body 61, and the coil spring 63*e* is compressed since the space between the L-shaped bracket 63*d* and the support bracket 63*a* reduces.

Further, a horizontal plate part 61*c* is provided on a substantially intermediate position of the said clamp body 61 in the vertical direction, and an air cylinder 67 is mounted on a lower end surface of this horizontal plate part 61*c*. A piston rod 67*a* of this air cylinder 67 is reciprocally projected from the upper surface of the horizontal plate part 61*c*. Further, a clamp pawl support plate 61*d* is integrally formed on the clamp body 61 on one side end on the upper surface of the said horizontal plate part 61*c*, and clamp pawls 68 and 69 serving as a vertical pair of clamp parts are rotatably supported by this clamp pawl support plate 61*d*.

These clamp pawls 68 and 69 are formed substantially in L shapes, formed in symmetrical shapes with each other, and rotatably supported on the said clamp pawl support plate 61*d* by spindles 68*a* and 69*a* whose respective base end portions extend in the horizontal direction. The apparatus is so formed that respective wire grasping surfaces 68*b* and 69*b* are approached to each other in the rotation positions shown in FIG. 13 and FIG. 14, for grasping the coated wire W between these wire grasping surfaces 68*b* and 69*b*.

In the vertical pair of clamp pawls 68 and 69, the lower clamp pawl 69 is formed with a horizontally extending slot 69*c*, so that an engaging pin 67*b* which is horizontally projected from an upper end portion of the said piston rod 67*a* is insertedly stopped in this slot 69*c*. Further, a portion in the upper clamp pawl 68 downward beyond the spindle 68*a* and a portion in the lower clamp pawl 69 downward beyond the spindle 69*a* are relatively rotatably coupled with each other.

Figure 15:
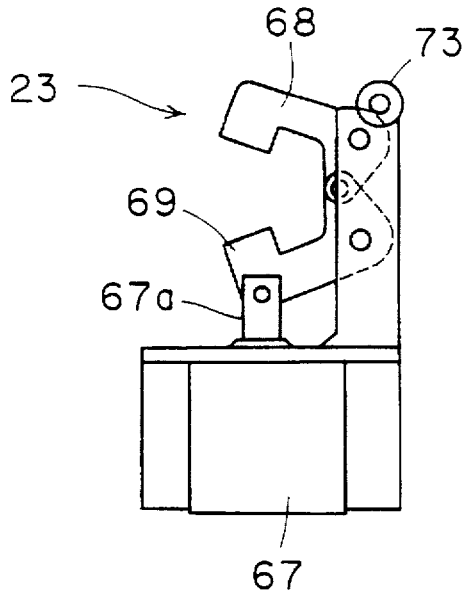
FIG. 15 is an explanatory diagram showing a wire grasping release state of the R clamp.

The respective clamp pawls 68 and 69 are formed to be rotated between wire grasping state positions where the respective wire grasping surfaces 68*b* and 69*b* are approached to each other following reciprocal movement of the piston rod 67*a* following driving of the said air cylinder 67 shown in FIG. 13 and FIG. 14, and open state positions mutually opened and separated as shown in FIG. 15.

As shown in FIG. 14, the terminal 57 which is pressure-connected to the end portion of the coated wire W is brought into a state placed on the pressure connection bed 71 of the terminal pressing machine 26, and this position is set downward beyond the position of the coated wire W which is grasped by the clamp pawls 68 and 69 of the R clamp 23 in a state not supplied with downward urging force. This is for avoiding such a state that the coated wire W comes into contact with the terminal 57 when the clamp body 61 moves from the initial position to the terminal pressing position.

Figure 16:
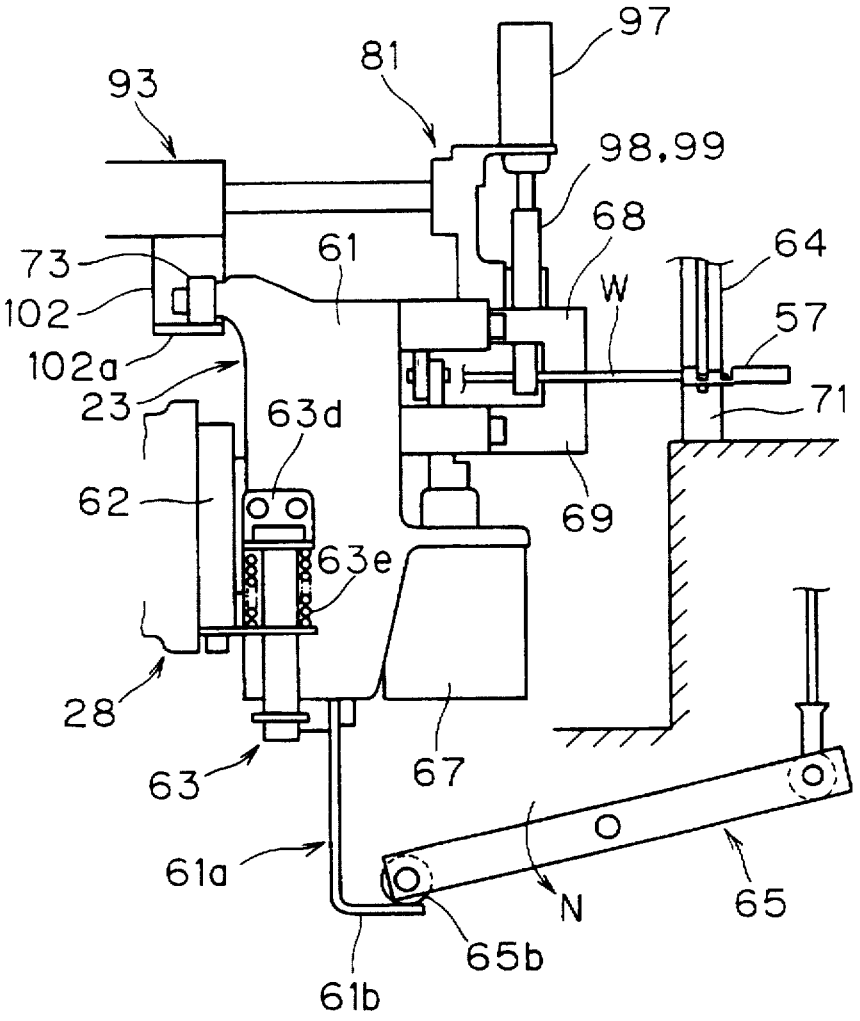
FIG. 16 is a diagram corresponding to FIG. 14 in terminal pressure connection.

Therefore, the apparatus is so formed that the clamp body 61 lowers by rotation of the linkage rod 65 following lowering of the pressure connection die 64 in the pressing operation of the terminal 57 to the forward end portion of the coated wire W as shown in FIG. 16, the coated wire W also lowers following this and pressure connection of the terminal 57 is performed by the pressure connection die 64 in a state being in contact with the terminal 57 on the pressure connection bed 71.

A linkage roller 73 serving as a second moving member is arranged on a position opposite to the arrangement positions of the said clamp pawls 68 and 69 on the upper end portion of the clamp body 61. This linkage roller 73 is supported by a spindle 73*b* horizontally extending on a forward end of an extension part 73*a* extending from the upper end portion of the clamp body 61.

Figure 18:
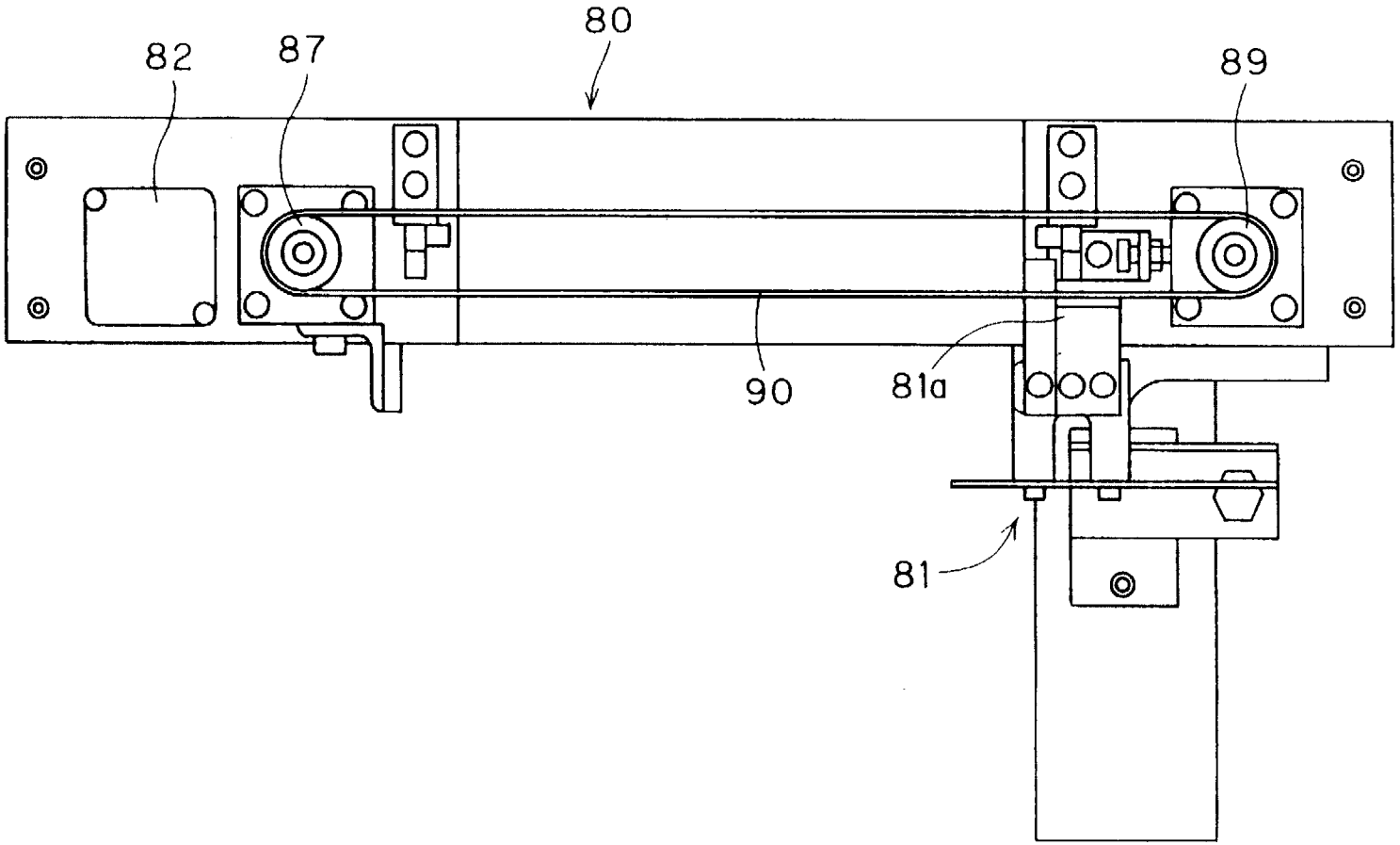
FIG. 18 is a plan view of the wire discharge machine.
Figure 19:
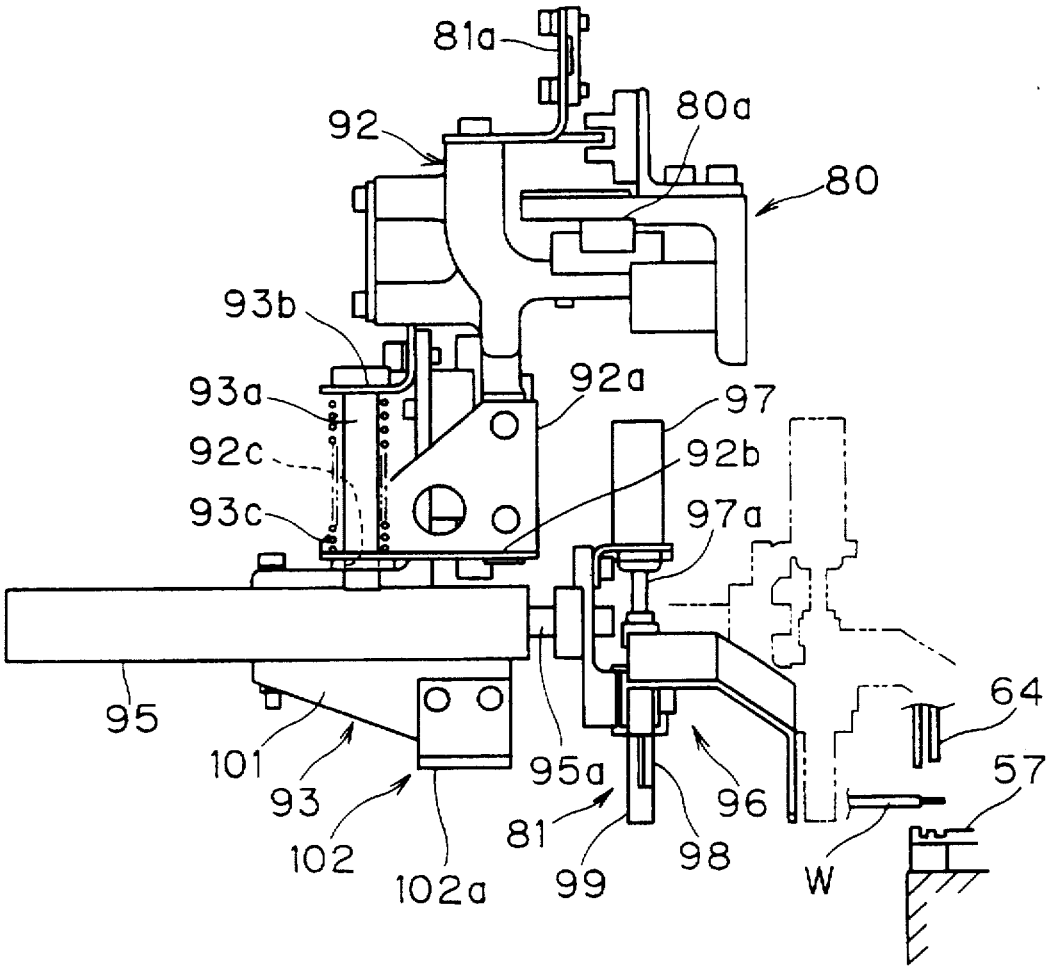
FIG. 19 is a side elevational view of the wire discharge machine.

The said wire discharge machine 29 is adapted to receive the coated wire W to which the terminal 57 is pressure-connected in the state grasped by the R clamp 23 from this R clamp 23 and discharge the same to the exterior of the apparatus 20. This wire discharge machine 29 comprises a discharge machine body 80 as shown in FIG. 17 to FIG. 19, and a wire grasping mechanism part 81 is horizontally slide-movably supported on the discharge machine body 80.

A horizontally extending guide rail 80*a* is arranged on the said discharge machine body 80, and the wire grasping mechanism part 81 is formed to be slide-movable in the horizontal direction along the guide rail 80*a*.

Figure 17:
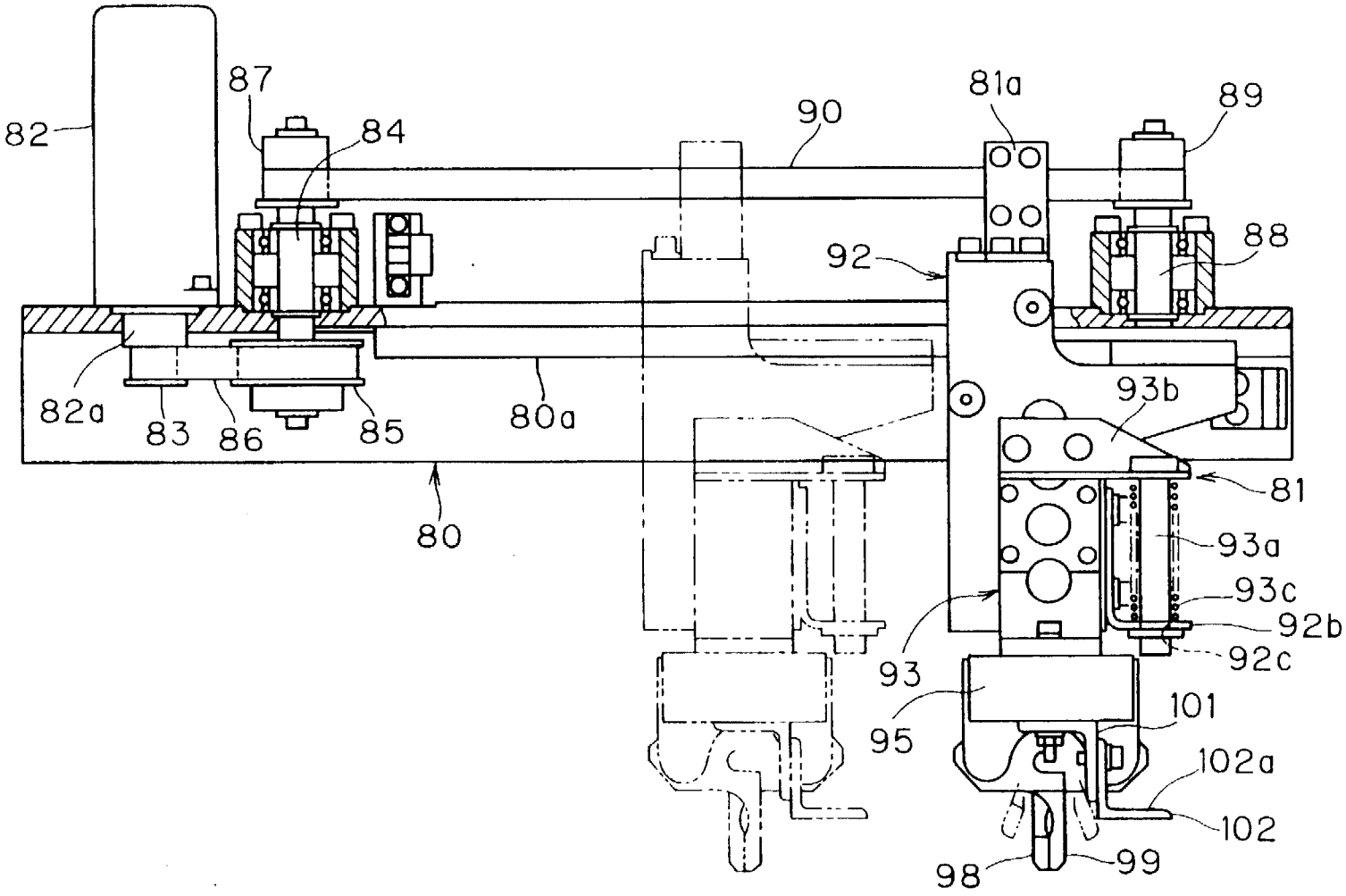
FIG. 17 is a front elevational view of the wire discharge machine.

Further, a servo motor 82 having a vertical driving shaft 82*a* is arranged on a left side end portion of FIG. 17 in the said discharge machine body 80, and the driving shaft 82*a* of this servo motor 82 passes through the discharge machine body 80 and extends under the discharge machine body 80, while a first pulley 83 is mounted on its forward end portion. A second pulley 85 having a vertical rotary shaft 84 is arranged on a side portion of the first pulley 83, and a belt 86 is extended between the first pulley 83 and the second pulley 85.

A third pulley 87 is arranged above the discharge machine body 80 in the said rotary shaft 84, while a fourth pulley 89 which is supported by a vertical rotary shaft 88 is arranged on a right side end portion of FIG. 17 above the discharge machine body 80, and a belt 90 is extended between the third pulley 87 and the fourth pulley 89.

Further, a bracket 81*a* which is provided on an upper end of the said wire grasping mechanism part 81 is coupled to this belt 90, and the apparatus is so formed that the belts 86 and 90 travel by rotation of the respective pulleys 83, 85, 87 and 89 following driving of the servo motor 82, whereby the wire grasping mechanism 81 slide-moves in the horizontal direction along the said guide rail 80*a*. The wire grasping mechanism part 81 is so formed as to reciprocate between a wire receiving position (solid line position in FIG. 17) for receiving the coated wire W from the said R clamp 23, and a wire discharge position (phantom line position in FIG. 17) for discharging this coated wire W to the exterior of the apparatus 20, due to this slide movement.

The said wire grasping mechanism part 81 comprises a wire grasping mechanism part body 92 and an up/down member 93, and the said bracket 81*a* is mounted on an upper end portion of the wire grasping mechanism part body 92. Further, a bracket 92*a* which is in a trapezoidal form in side elevational view is mounted on a lower end portion of this wire grasping mechanism part body 92 as shown in FIG. 19, and a horizontally extending horizontal plate part 92*b* is comprised on a lower end edge portion of this bracket 92*a*. Further, a vertically passing opening 92*c* is formed in this horizontal plate part 92*b*.

An upper end portion of an up/down rod 93*a* inserted in the opening 92*c* which is formed in the horizontal plate part 92*b* of the said bracket 92*a* is connected to the said up/down member 93 through an L-shaped bracket 93*b*, and a coil spring 93*c* is compressedly mounted between this L-shaped bracket 93*b* and the horizontal plate part 92*b* of the said bracket 92*a*.

The apparatus is so formed that the up/down rod 93*a* also lowers following lowering of the up/down member 93 when downward urging force acts on the said up/down member 93 and the space between the L-shaped bracket 93*b* and the horizontal plate part 92*b* of the said bracket 92*a* reduces following this, whereby the coil spring 28*c* is compressed.

Further, an air cylinder 95 having a horizontally reciprocable piston rod 95*a* is arranged on a lower end portion of the said up/down member 93. A wire grasping part 96 is mounted on a forward end portion of the piston rod 95*a* of this air cylinder 95.

This wire grasping part 96 comprises an air cylinder 97 having a downwardly reciprocable piston rod 97*a*, and clamp pawls 98 and 99 serving as receiving clamp parts for grasping the coated wire W are provided on a forward and portion of the piston rod 97*a* of this air cylinder 97 to be freely switchable following driving of the air cylinder 97. The apparatus is so formed that the coated wire W is grasped by the clamp pawls 98 and 99 in closed states of the respective clamp pawls 98.

On a lower end surface of the air cylinder 95 of the said up/down member 93 through an L-shaped bracket 101, a lowering lever 102 serving as an identically L-shaped first moving member is arranged, and this lowering lever 102 comprises a horizontally extending horizontal part 102*a*. The height position of an upper surface of this horizontal part 102*a* is set slightly downward beyond the height position of a lower end of the linkage roller 73 which is provided on the said R clamp 23 so that the R clamp 23 thereby transfers the coated wire W to the wire discharge machine 29, whereby the linkage roller 73 is formed to be positioned on an immediate upper portion having a slight space with the horizontal part 102*a* of the lowering lever 102 in a state moving to an opposite position of this wire grasping mechanism part 81 (refer to FIG. 14).

In this state, further, a wire grasping height position of the R clamp 23 and the height positions of the clamp pawls 98 and 99 of the wire grasping mechanism part 81 are substantially coincided with each other. Namely, the wire grasping height position of the R clamp 23 and the wire grasping height positions of the clamp pawls 98 and 99 of the wire grasping mechanism part 81 are so set that the same are coincided with each other in such a state that the R clamp 23 lowers and the linkage roller 73 comes into contact with the upper surface of the horizontal part 102*a* of the lowering lever 102.

Then, a pressing operation of the terminal 57 by the rear side terminal pressing machine 26 and a wire transfer operation from the R clamp 23 to the wire discharge machine 29 are described.

First, when cutting and peeling of the coated wire W are completed by the cutter part 24 in such a state that the R clamp 23 grasps the coated wire W in the initial position, the R clamp 23 moves along the guide rail 62, and is moved from the said initial position to the terminal pressing position opposed to the rear side terminal pressing machine 26. Namely, it comes to that the same is moved from the position shown by the solid lines of FIG. 13 to the position shown by the phantom lines.

In this state, the height position of the coated wire W is positioned above the arrangement height position of the terminal 57 in order to avoid interference between the coated wire W and the terminal 57 (refer to FIG. 14). At this time, the linkage roller 73 which is provided on the R clamp 23 is positioned immediately above the horizontal part 102*a* of the lowering lever 102 which is provided on the up/down member 93 of the wire discharge machine 29 (refer to FIG. 14). In this case, the linkage roller 73 and the lowering lever 102 are not in contact with each other, whereby no unnecessary force acts on the wire discharge machine 29, and the position of the up/down member 93 is maintained on the prescribed wire receiving position.

The apparatus shifts to the pressing operation for the terminal 57 from this state. This operation comes to that, as shown in FIG. 16, the linkage rod 65 rotates in a direction of arrow N following lowering of the pressure connection die 64 and the roller 65*b* provided on the linkage rod 65 comes into contact with the horizontal part 61*b* of the arm member 61*a*, for lowering the R clamp 23 by downwardly pressing the horizontal part 61*b*. At this time, the coil spring 63*e* is compressed in the up/down mechanism 63 following lowering of the L-shaped bracket 63*d*.

In the lowering operation of this R clamp 23, the linkage roller 73 provided on the clamp body 61 of the R clamp 23 lowers, whereby the linkage roller 73 comes into contact with the upper surface of the horizontal part 102*a* of the lowering lever 102 provided on the up/down member 93 of the wire grasping mechanism part 81 to downwardly push the lowering lever 102. Thus, the up/down member 93 comes to be lowered while the coil spring 93*c* is compressed. Namely, it comes to that the said linkage roller 73 comes into contact with the horizontal part 102*a* of the lowering lever 102, whereby the up/down member 93 is lowered in synchronization with lowering of the R clamp 23.

In such a state that the linkage roller 73 is thus in contact with the lowering lever 102, the wire grasping height position of the R clamp 23 and the wire grasping high positions of the clamp pawls 98 and 99 of the wire grasping mechanism part 81 are coincided with each other, whereby the apparatus is in such a state that a prescribed position of the coated wire W can be grasped by the clamp pawls 98 and 99 when the air cylinder 97 of the up/down member 93 is driven in downward movement of this R clamp 23 and the up/down member 93 for rotating the clamp pawls 98 and 99 in wire grasping directions. In this state, the wire grasping part 96 is advanced to a wire receiving position shown by phantom lines in FIG. 19 by driving of the air cylinder 95 comprised in the up/down member 93.

In such a state that the R clamp 23 reaches an up/down lower end position as shown in FIG. 16, the forward end portion of the coated wire W which is grasped by the respective clamp pawls 68 and 69 is positioned in the interior of the terminal 57, and the terminal 57 is pressure-connected to the forward end portion of the coated wire W in this state by the pressure connection die 64. Further, when the air cylinder 97 of the said up/down member 93 is driven simultaneously with the pressing operation of this terminal 57 for rotating the clamp pawls 98 and 99 in the wire grasping directions, the prescribed position of the coated wire W is grasped by the clamp pawls 98 and 99. In this state, both of the clamp pawls 68 and 69 of the R clamp 23 and the clamp pawls 98 and 99 of the wire discharge machine 29 are in states grasping the coated wire W.

Figure 20:
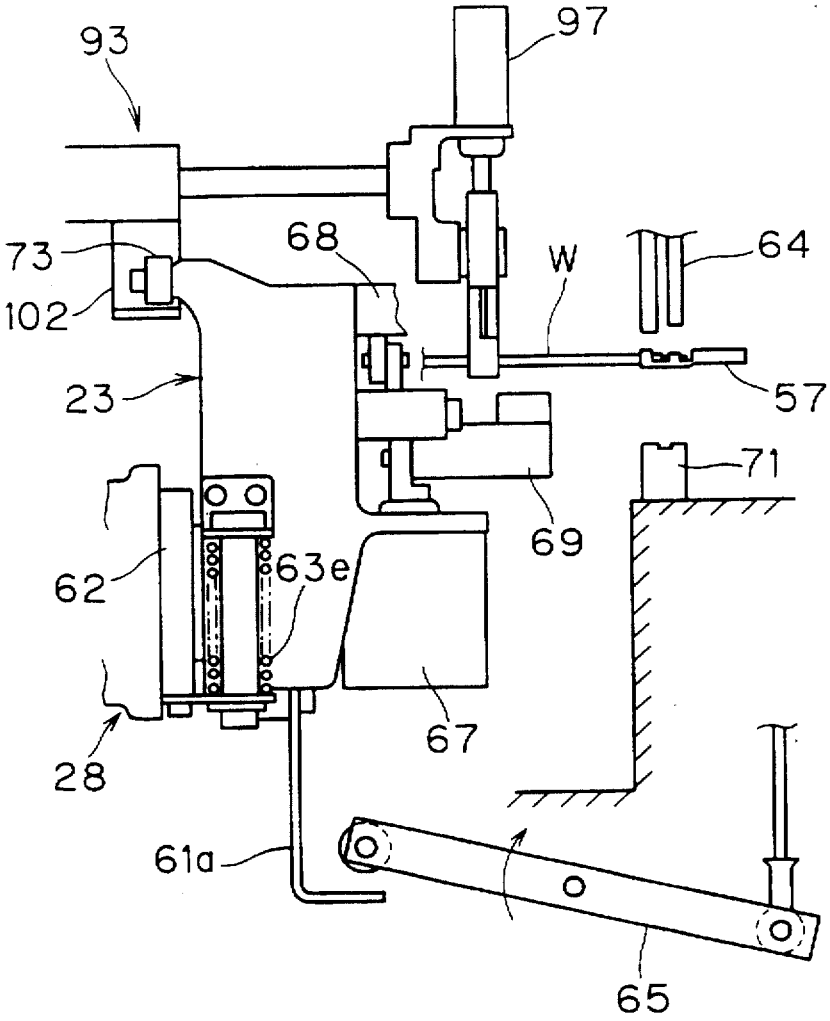
FIG. 20 is a diagram corresponding to FIG. 14 in completion of terminal pressure connection.

Immediately after this operation, the pressure connection die 64 is upwardly moved as shown in FIG. 20, whereby the R clamp 23 and the up/down member 93 upwardly move by the urging force of the respective coil springs 93*e* and 93*c* to return to the original positions following this. At the time of the upward movement of this R clamp 23 and the up/down member 93, the air cylinder 67 of the R clamp 23 drives to retract its piston rod 67*a* as shown in FIG. 15, for rotating the respective clamp pawls 68 and 69 in directions separating from each other and releasing the grasped state of the coated wire W.

Here, the coated wire W enters such a state that only the clamp pawls 98 and 99 of the wire discharge machine 29 grasp the same, and transfer of the coated wire W from the R clamp 23 to the wire discharge machine 29 is completed. At this time, the wire grasping part 96 is returned by driving of the air cylinder 95 comprised in the up/down member 93 from the wire receiving position shown by the phantom lines in FIG. 19 to the initial position shown by the solid lines.

As hereinabove described, synchronous moving means for upwardly/downwardly moving the clamp pawls 98 and 99 of the wire grasping part 96 in synchronization with upward/downward movement of the clamp pawls 68 and 69 of the R clamp 23 in the terminal pressing operation of the terminal pressing machine 26 is formed by the said linkage roller 73, the coil spring 93*c*, the lowering lever 102 and the like.

When the transfer of the coated wire W is thus completed and the R clamp 23 and the up/down member 93 reach upward positions together, the R clamp 23 is returned from the terminal pressing position to the initial position along the guide rail 62. In the wire discharge machine 29, on the other hand, the servo motor 82 is driven and the belts 86 and 90 travel, so that the wire grasping mechanism part 81 slide-moves on the discharge machine body 80 along the guide rail 80*a*, to move from the wire receiving position to the wire discharge position.

The wire grasping mechanism part 81 moving to the wire discharge position discharges the completely handled coated wire W to the exterior of the apparatus 20, whereafter the servo motor 82 is driven in a direction opposite to the above so that the mechanism part 81 returns to the wire receiving position again. Such an operation is successively repeated, whereby coated wires W to which terminals 57 are completely pressure-connected are continuously discharged from the wire discharge machine 29.

Figure 21:
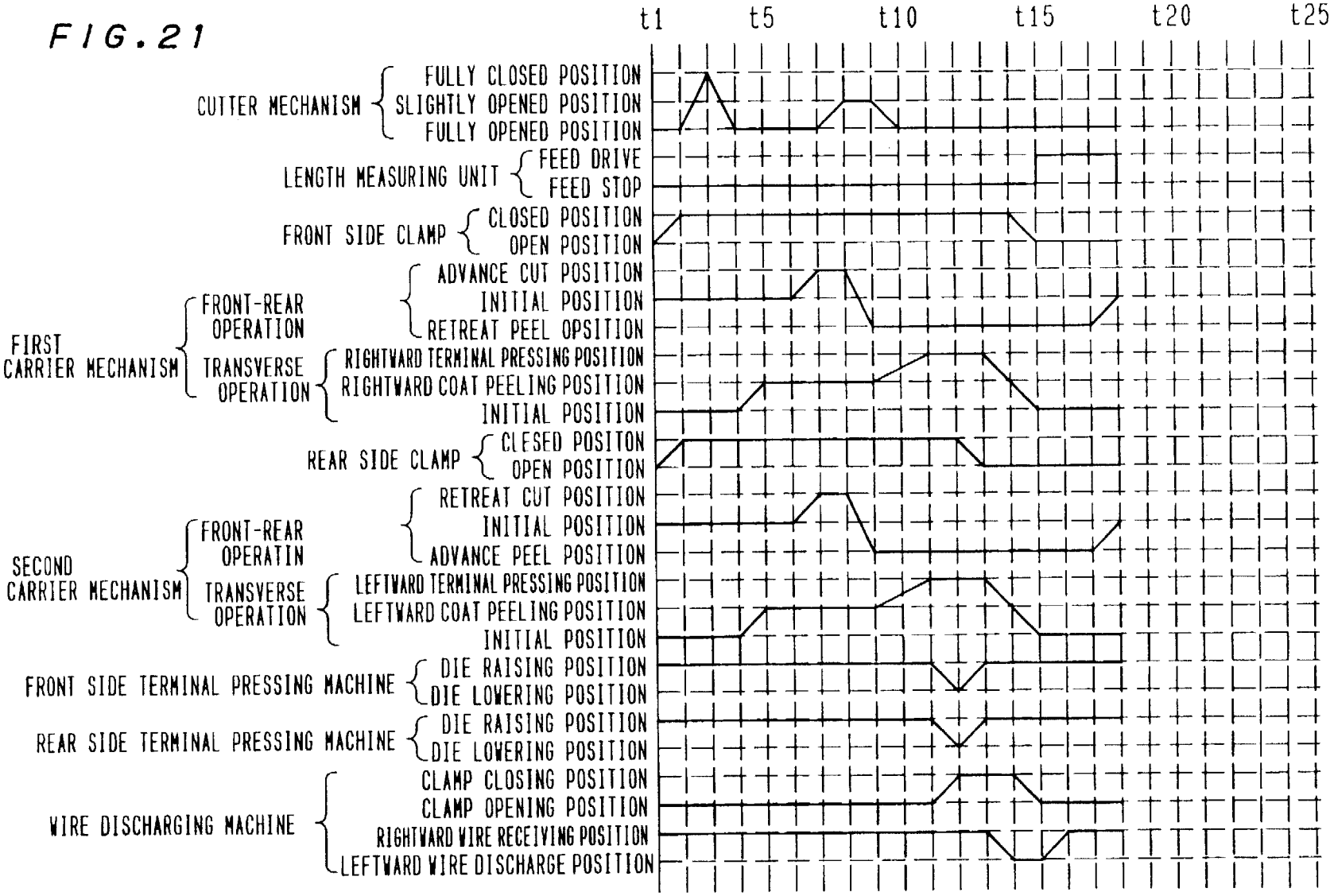
FIG. 21 is a time chart related to the first embodiment.

The handling operations of the overall wire handling apparatus 20 are now described with reference to a time chart of FIG. 21.

Namely, when an operation start instruction is supplied, the F clamp 22 and the R clamp 23 are positioned on the initial positions, so that the respective clamps 22 and 23 are brought to open positions not grasping the coated wire W. In this state, the coated wire W is fed by the length measuring unit 21, and the feed of the coated wire W by the length measuring unit 21 is stopped when the amount of delivery reaches a prescribed dimension (time t1). The amount of delivery of the coated wire W by the length measuring unit 21 in this case is properly set.

Thereafter the respective clamps 22 and 23 are brought to closed positions and grasp the coated wire W (time t2). Then, the respective cutters 58 of the cutter mechanism 24 fully open so that the coated wire W is cut (time t3).

Thereafter the respective cutters 58 are fully opened (time t4), and the F clamp 22 and the R clamp 23 are transversely operated in opposite directions respectively, and positioned on peeling positions (times t5 to t6). Then, the F clamp 22 and the R clamp 23 are front-rear operated in opposite directions respectively, so that the coated wires W are positioned on cut positions (times t6 to t7).

Then, when the coated wires W grasped by the respective clamps 22 and 23 are positioned on the cut positions, the respective cutters 58 are close-operated, enter slightly opened positions, and are brought to states biting into the coated parts Wa of the coated wires W (time t8). In this state, the respective clamps 22 and 23 are front-rear operated in opposite directions respectively and positioned on peeling positions, so that the coated parts Wa are peeled (time t9).

Then, the respective cutters 58 are open-operated to enter full open positions, so that the respective clamps 22 and 23 grasping the peeled coated wires W are moved to corresponding terminal pressing positions respectively (times t10 to t11). The pressure connection dies 54 and 64 of the respective terminal pressing machines 25 and 26 are lowered when the respective clamps 22 and 23 reach the terminal pressing positions, and the clamp pawls 98 and 99 of the wire discharge machine 29 are close-operated in the lowering of this terminal pressing machine 26 (times t11 to t12).

Thereafter the pressure connection dies 54 and 64 of the respective terminal pressing machines 25 and 26 are upwardly moved so that the clamp pawls 68 and 69 of the R clamp 23 are open-operated in the upward movement of the pressure connection die 64 of this terminal pressing machine 26 (times t12 to t13). Here, the coated wire W completed with the pressure connection of the terminal 57 is transferred from the R clamp 23 to the wire discharge machine 29 side.

Thereafter the respective clamps 22 and 23 are transverse-operated and returned to the initial positions (times t13 to t15). At this time, the wire discharge machine 29 is moved from the wire receiving position to the wire discharge position (times t13 to t14), and the clamp pawls 98 and 99 of the wire discharge machine 29 are open-operated on the wire discharge positions, for releasing grasping of the coated wire W (times t14 to t15). Further, the grasping of the coated wire W by the F clamp 22 is released (times t14 to t15).

Then, the length measuring unit 21 is driven so that the coated wire W is fed by the prescribed dimension again (times t15 to t18). At this time, the F clamp 22 and the R clamp 23 are front-rear operated and returned to the initial positions (times t17 to t18), and the wire discharge machine 29 is returned from the wire discharge position to the wire receiving position (times t15 to t16).

This return of the F clamp 22 and the R clamp 23 to the initial positions by the front-rear operations may be at any time so far as the same is before the prescribed dimension feed of the coated wire W by the length measuring unit 21 is completed.

Such operations are repeated so that coated wires W to which the terminals 57 are completely pressure-connected are successively discharged from the wire discharge machine 29.

Figure 22:
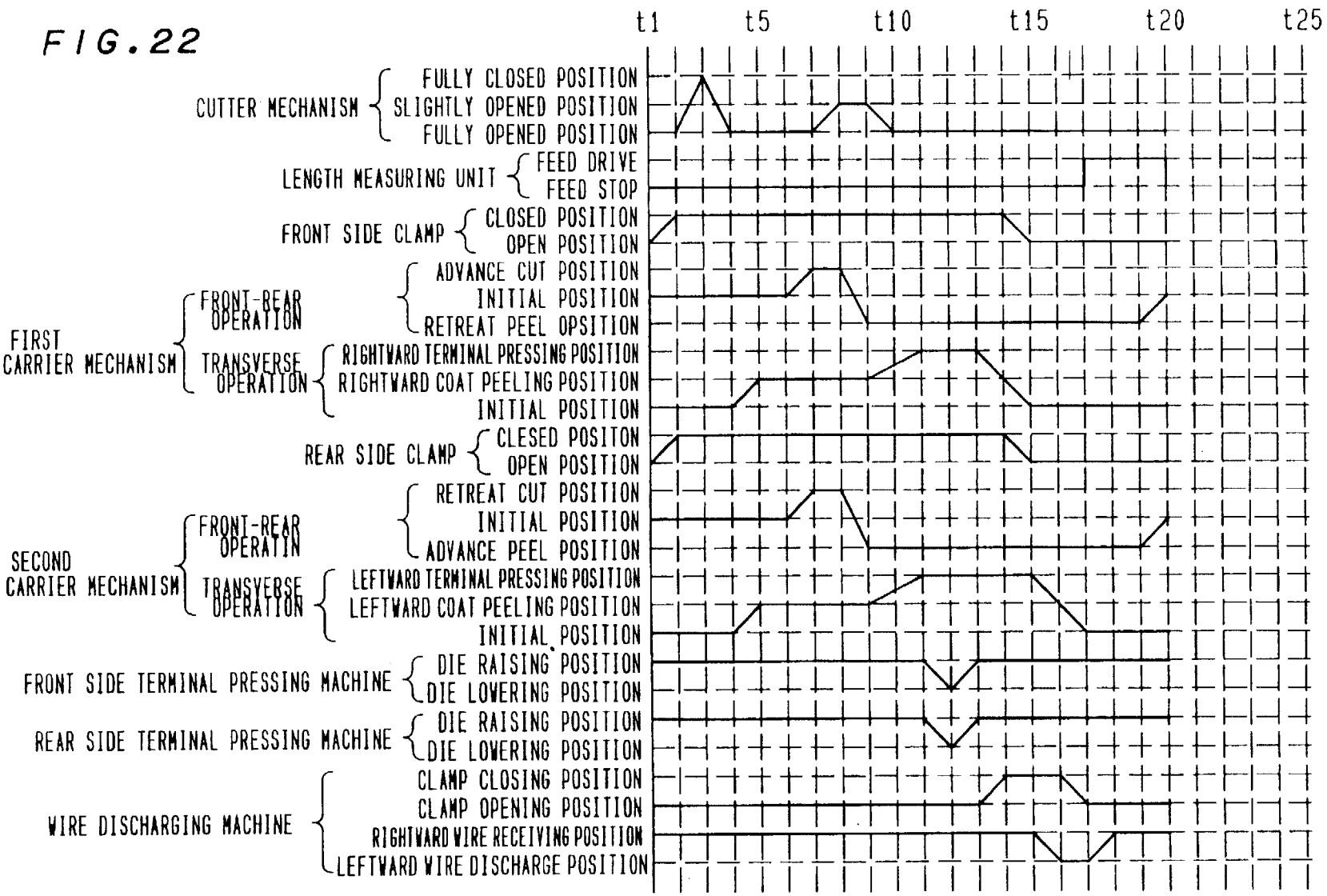
FIG. 22 is a time chart related to the prior art.

FIG. 22 shows a time chart in the prior art corresponding to this embodiment, which prior art is brought into a system of transferring the coated wire W grasped by the R clamp 23 to the wire discharge machine 29 after pressure connection of the terminal 57, and other portions are made substantially similar to the aforementioned embodiment.

According to the wire handling apparatus 20 of this embodiment, as hereinabove described, the up/down member 93 of the wire discharge machine 29 is upwardly/downwardly moved at the time of the terminal pressing operation to the end of the coated wire W grasped by the upwardly/downwardly moving R clamp 23 so that there is no relative movement between the up/down member 93 and the R clamp 23, whereby there is no relative movement of this up/down member 93 and the coated wire W either and it is possible to make the grasping of the prescribed position of the coated wire W by the clamp pawls 98 and 99 of the up/down member 93 excellently performed while it is possible to make the pressing operation of the terminal 57 to the forward end portion of the coated wire W and the transfer operation of the coated wire W from the R clamp 23 to the wire discharge machine 29 simultaneously performed, and reduction of the wire handling time can be attained while improvement of reliability of the coated wire W transfer operation can be attained.

Namely, it has been necessary to temporarily stop the R clamp 23 so that the clamp pawls 98 and 99 of the up/down member 93 excellently grasp the prescribed position of the coated wire W in such a structure that the up/down member 93 and the coated wire W relatively move as in the prior art, while there is no such necessity according to this embodiment, it is possible to reduce the operation time of the R clamp 23 so that the return operation of the R clamp 23 to the initial position can be synchronized with the return operation of the F clamp 22 to the initial position, and it has become possible to make the wire discharge machine 29 grasp the prescribed position of the coated wire W while attaining reduction of the overall operation time.

Further, the linkage roller 73 comes into contact with the lowering lever 102 following upward/downward movement of the clamp pawls 68 and 69 of the R clamp 23 in the pressing operation of the terminal 57 by the terminal pressing machine 26 to upwardly/downwardly move the clamp pawls 98 and 99 of the wire discharge machine 29 in synchronization, whereby the movement of the clamp pawls 98 and 99 of the wire discharge machine 29 is performed by driving force of the upward/downward movement of the clamp pawls 68 and 69 of the R clamp 23 and no driving source for upward/downward driving of the clamp pawls 98 and 99 is necessary, and hence simplification of the structure as the overall apparatus 20 can be attained.

In addition, the apparatus is set in a position having a slight space between the linkage roller 73 and the horizontal part 102*a* of the lowering lever 102, whereby no unnecessary force acts on the lowering lever 102 side, and malfunctions on the sides of the clamp pawls 98 and 99 can be effectively prevented.

The grasping of the coated wire W by the clamp pawls 98 and 99 of the up/down member 93 may not be performed on the up/down lower end position of the R clamp 23 but the grasping operation may be started in any condition so far as the up/down member 93 and the R clamp 23 are in states synchronously upwardly/downwardly moving in such a state that the coated wire W is grasped by the clamp pawls 68 and 69 of the R clamp 23, whereby there is such an advantage that the degree of freedom of the control operation of the clamp pawls 98 and 99 of this up/down member 93 is largely ensured.

As to the release operation of the wire grasping state by the clamp pawls 68 and 69 of the R clamp 23, further, the grasped state may be released in any condition so far as the up/down member 93 and the R clamp 23 are in states synchronously upwardly/downwardly moving in such a state that the coated wire W is grasped by the clamp pawls 68 and 69 of the R clamp 23, whereby there is such an advantage that the degree of freedom of the control operation of the clamp pawls 68 and 69 of this R clamp 23 is also largely ensured.

Therefore, although the R clamp 23 is made to perform the grasping operation of the coated wire W by the clamp pawls 98 and 99 of the wire discharge machine 29 and the grasping releasing operation of the coated wire W by the clamp pawls 68 and 69 of the R clamp 23 around the up/down lower end position in the aforementioned embodiment, the present invention is not in any way restricted to this.

Further, the apparatus is in such a structure that the swing holder 33 is downwardly swung in synchronization with lowering of the pressure connection die 54 at the time of pressure-connecting the terminal 57 to the end portion of the coated wire W grasped by the F clamp 23 by the terminal pressing machine 25 so that the length measuring rollers 36*a* and 36*b* bringing the coated wire W supported by the swing holder 33 into a held state and the F clamp 22 integrally incline, whereby no strong tensile force is caused on the coated wire W between the length measuring rollers 36*a* and 36*b* and the F clamp 22 in the said pressure connection, although the coated wire W is held by both length measuring rollers 36*a* and 36*b*. Therefore, occurrence of elongation or a bending tendency of the coated wire W can be effectively prevented, while occurrence of dispersion in measured lengths in the next step can also be effectively prevented since the coated wire W is held by both length measuring rollers 36*a* and 36*b* during the pressure connection.

Further, it is not necessary to contact/separate both length measuring rollers 36*a* and 36*b* with/from each other, whereby there is no need to separately provide contact/separation operation means for contact/separation operations dissimilarly to the prior art, control thereof is also unnecessary, and simplification of the structure can be attained.

As compared with the case where only the F clamp 22 is swung as in the prior art, the sides of the length measuring rollers 36*a* and 36*b* and the F clamp 22 are in structures of being integrally swung about the spindle 32, and the distance from the swing center to the terminal 57 pressing position is lengthened, whereby there are such advantages that the angle of inclination by swinging of the coated wire W can be reduced, the supply attitude of the coated wire W end portion with respect to the terminal 57 on the pressure connection bed 53 becomes more excellent, and an excellent pressure connection state can be attained.

Figure 23:
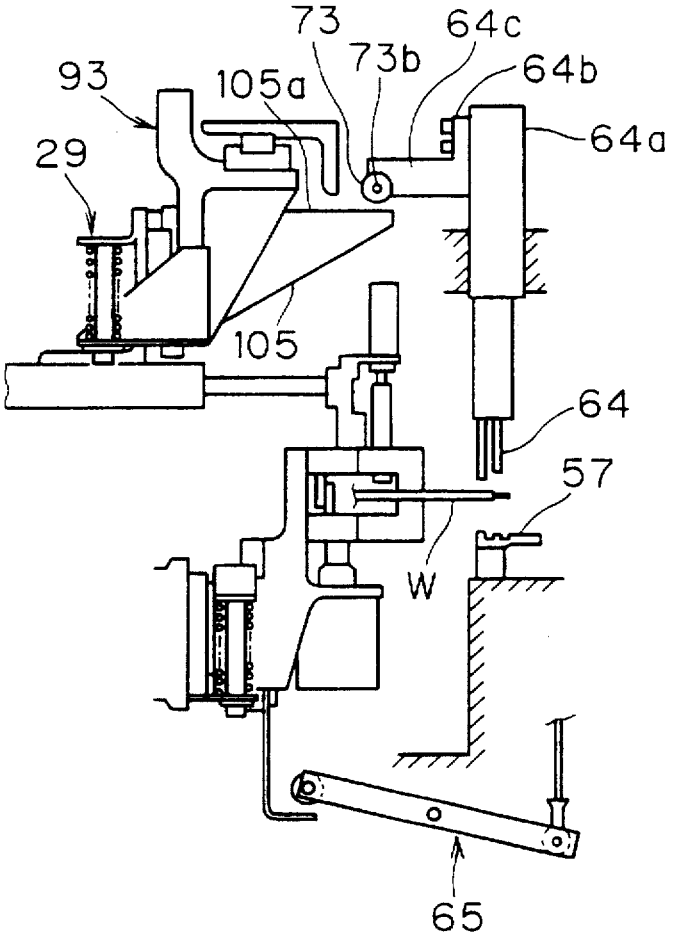
FIG. 23 is a diagram corresponding to FIG. 14 related to a second embodiment.

FIG. 23 shows a second embodiment, and the basic structure of a wire handling apparatus 20 in this embodiment is substantially similar to that of the aforementioned first embodiment, and hence description is made only on a point different from the first embodiment in this embodiment.

In the wire handling apparatus 20, an L-shaped bracket 64*b* is mounted on a slider 64*a* supporting an upper end portion of a pressure connection die 64, and a horizontal part 64*c* of this bracket 64*b* extends toward a wire discharge machine 29 side. A linkage roller 73 which is supported by a horizontally extending spindle 73*b* is arranged on a forward end portion of the horizontal part 64*c* of this bracket 64*b*.

On the other hand, a lowering bracket 105 is mounted on a surface opposite to the said pressure connection die 64 in an up/down member 93 in the wire discharge machine 29. In this lowering bracket 105, its upper end portion is formed in a horizontally extending horizontal part 105*a*, and the height position of this horizontal part 105*a* is set slightly downward beyond the lower surface of the said linkage roller 73.

In a pressing operation of a terminal 57 to an end portion of a coated wire W, therefore, it comes to that the linkage roller 73 comes into contact with the horizontal part 105*a* of the lowering bracket 105 due to lowering of the linkage roller 73 following lowering of the pressure connection die 64, to downwardly move the up/down member 93 of the wire discharge machine 29. At this time, further, the linkage rod 65 rotates and the R clamp 23 is also lowered due to the lowering of the said pressure connection die 64, similarly to the case of the said first embodiment.

Also in the structure of this embodiment, as hereinabove described, it comes to that upward/downward movement of the R clamp 23 and the upward/downward movement of the up/down member 93 due to the lowering of the pressure connection die 64 can be synchronized with each other, the pressing operation of the terminal 57 to an end portion of the coated wire W and a transfer operation of the coated wire W from the R clamp 23 to the wire discharge machine 29 can be made simultaneously performed and it is possible to make the wire discharge machine 29 grasp a prescribed position of the coated wire W while attaining reduction of a wire handling time.

Figure 24:
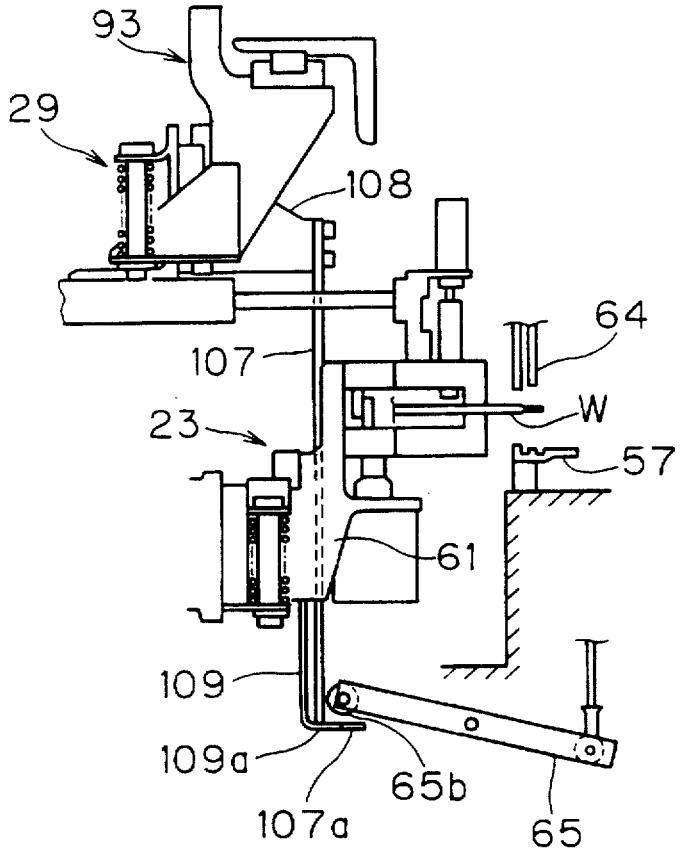
FIG. 24 is a diagram corresponding to FIG. 14 related to a third embodiment.
Figure 25:
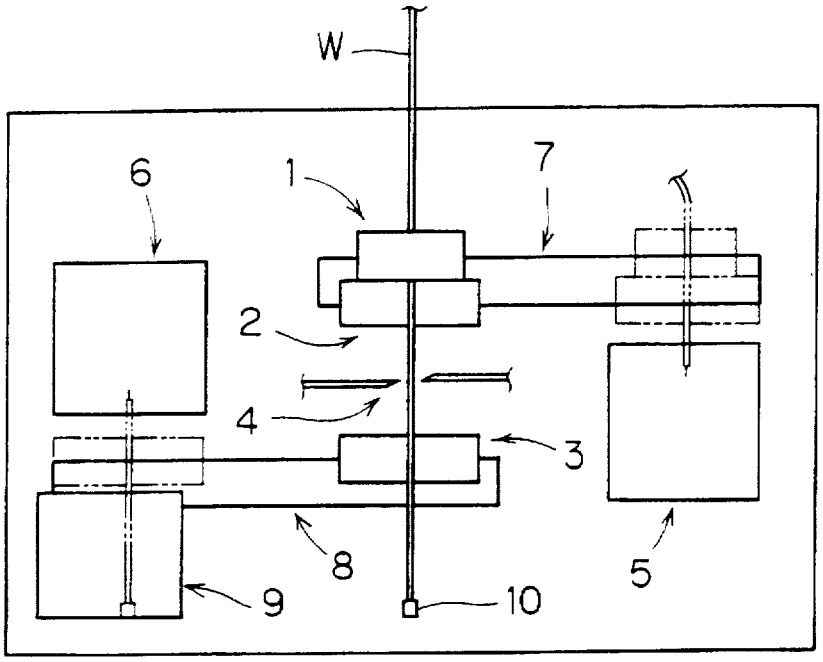
FIG. 25 is a schematic explanatory diagram of the prior art.
Figure 26:
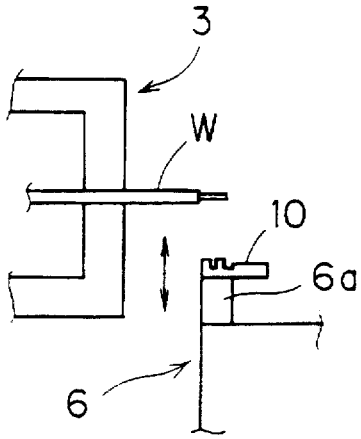
FIG. 26 is an upward/downward operation explanatory diagram of an R clamp in the prior art.
Figure 27:
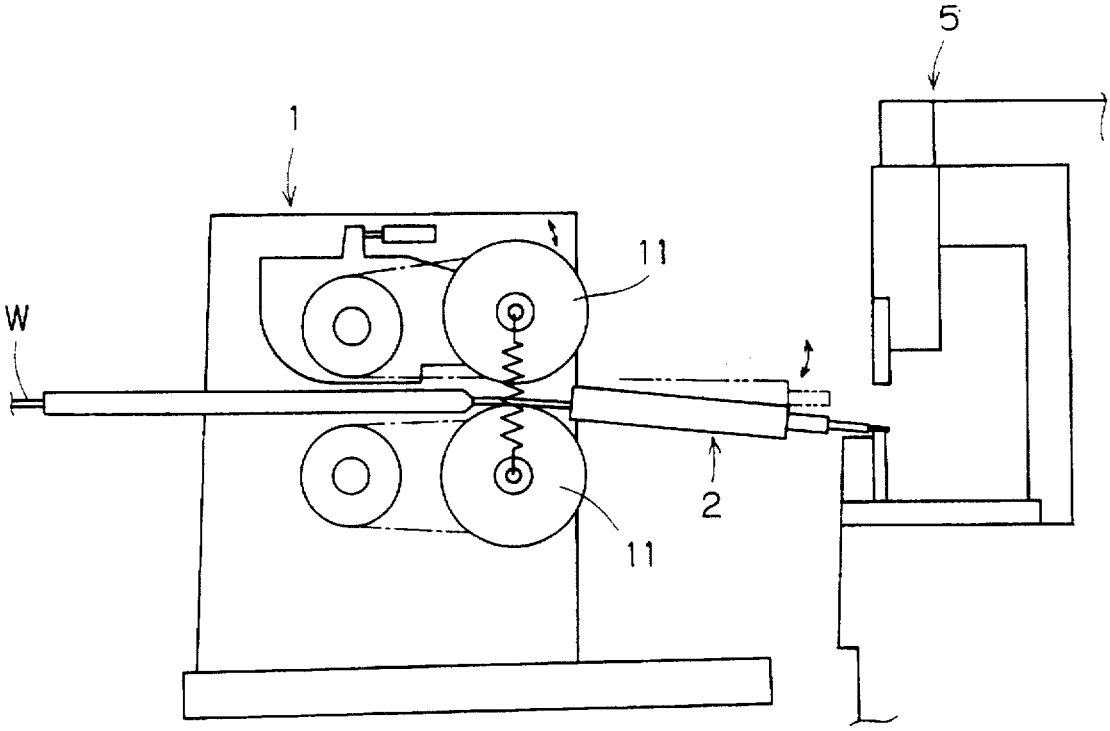
FIG. 27 is a swing operation explanatory diagram of an F clamp in the prior art.

FIG. 24 shows a third embodiment, and the basic structure of a wire handling apparatus 20 in this embodiment is also substantially similar to that of the said first embodiment, and hence description is made only on a point different from the first embodiment also in this embodiment.

In the wire handling apparatus 20, a lowering lever 107 is mounted on a surface opposite to the said pressure connection die 64 in an up/down member 93 of a wire discharge machine 29. In this lowering lever 107, its upper end portion is mounted on the said up/down member 93 through a bracket 108, while its lower end portion is extended downward beyond an arrangement height position of a clamp body 61 of an R clamp 23. This lowering lever 107 is formed in an L shape for forming a horizontal part 107*a* similarly to a lowering lever 109 which is mounted on the lower surface of the clamp body 61 of the R clamp 23. The height position of the horizontal part 107*a* of the lowering lever 107 which is mounted on this up/down member 93 is coincided with the height position of a horizontal part 109*a* of the lowering lever 109 which is mounted on the said R clamp 23, and set on a position opposite to a linkage rod 65.

In a pressing operation of a terminal 57 to an end portion of a coated wire W, therefore, it comes to that a roller 65*b* arranged on a forward end portion of this linkage rod 65 comes into contact with the horizontal parts 107*a* and 109*a* of the respective lowering levers 107 and 109 due to rotation of the linkage rod 65 following lowering of the pressure connection die 64, to simultaneously downwardly move the R clamp 23 and the up/down member 93 of the wire discharge machine 29. Also in the structure of this embodiment, as hereinabove described, it comes to that up/down movement of the R clamp 23 and upward/downward movement of the up/down member 93 due to the lowering of the pressure connection die 64 are synchronized with each other, whereby the pressing operation of the terminal 57 to the end portion of the coated wire W and a transfer operation of the coated wire W from an R clamp 23 to the wire discharge machine 29 can be made simultaneously performed and it is possible to make the wire discharge machine 29 grasp a prescribed position of the coated wire W while attaining reduction of a wire handling time.

We claim:

1. A wire handling apparatus comprising a length measuring unit for intermittently delivering a coated wire by prescribed dimensions, a first clamp mechanism and a second clamp mechanism being successively arranged downstream a wire feed direction of said length measuring unit for releasably grasping said delivered coated wire, a cutter mechanism being positioned and arranged between both said clamp mechanisms for performing cutting peeling of the coated wire being grasped by each said clamp mechanisms to produce a peeled coated wire, a first terminal pressing mechanism and a second terminal pressing mechanism being arranged in correspondence to side portions of said clamp mechanisms respectively for pressing terminals to end portions of said peeled coated wire, a first carrier mechanism and a second carrier mechanism for carrying the coated wire being respectively grasped by a clamp part of said first clamp mechanism and second clamp mechanism to the corresponding first terminal pressing mechanism and the second terminal pressing mechanism respectively, and a wire discharge mechanism having a receiving clamp part for receiving the coated wire to which the terminal is pressure-connected by the second terminal pressing mechanism from the clamp part of the second clamp mechanism so that the clamp part of the second clamp mechanism is upwardly/downwardly moved in a terminal pressing operation by the second terminal pressing mechanism, wherein synchronous moving means for upwardly/downwardly moving said receiving clamp part in synchronization with the upward/downward movement of the clamp part of said second clamp mechanism in the terminal pressing operation of said second terminal pressing mechanism is provided while the position of said receiving clamp part is coincided with the position of the coated wire so that the grasping of the coated wire by the receiving clamp part is enabled in the terminal pressing operation of the second terminal pressing mechanism.

2. The wire handling apparatus in accordance with claim 1, wherein said synchronous moving means comprises a first moving member being integrally provided on the receiving clamp part of the wire discharge mechanism, and a second moving member being integrally provided on the clamp part of the second clamp mechanism and arranged in proximity to said first moving member, so that the second moving member comes into contact with the first moving member following the upward/downward movement of said second clamp mechanism in the terminal pressing operation of said second terminal pressing machine for moving said receiving clamp part in synchronization with the upward/downward movement of the clamp part of said second clamp mechanism.

3. The wire handling apparatus in accordance with claim 2, wherein said second moving member is set on a position having a slight space with respect to said first moving member.

4. The wire handling apparatus in accordance with claim 1, wherein said length measuring unit comprises a pair of length measuring rollers being separably elastically pressed against each other for delivering said coated wire, said first carrier mechanism comprises a horizontal moving part being moved in a horizontal plane, said length measuring rollers and the first clamp mechanism are mounted on a swing member being vertically swingably supported on said horizontal moving part side, and synchronous swing means for engaging with said swing member and vertically swinging the swing member is provided in order to upwardly/downwardly move the first clamp mechanism in the terminal pressing operation by said first terminal pressing mechanism.

5. The wire handling apparatus in accordance with claim 4, wherein a return member for upwardly returning said swing member to an initial position is comprised.

6. A wire handling apparatus comprising a length measuring unit comprising a pair of length measuring rollers for intermittently delivering a coated wire having prescribed dimensions, a clamp mechanism being arranged downstream a wire feed direction of said length measuring unit for releasably grasping said delivered coated wire, a cutter mechanism performing cutting-peeling of the coated wire being grasped by said clamp mechanism, a terminal pressing mechanism being arranged in correspondence to a side portion of said clamp mechanism for pressing a terminal to an end portion of said peeled coated wire, and a carrier mechanism for carrying the coated wire being grasped by said clamp mechanism to the terminal pressing mechanism position so that said clamp mechanism is upwardly/downwardly moved in a terminal pressing operation by said terminal pressing mechanism, wherein said carrier mechanism comprises a horizontal moving part being moved in a horizontal plane, said pair of length measuring rollers and the clamp mechanism are mounted on a swing member being vertically swingably supported on said horizontal moving part side, and synchronous swing means for engaging with said swing member and vertically swinging the swing member is provided for upwardly/downwardly moving the clamp mechanism in the terminal pressing operation by said terminal pressing mechanism.

7. The wire handling apparatus in accordance with claim 6, wherein a return member for upwardly returning said swing member to an initial position is comprised.

* * * * *